US009342944B2

(12) United States Patent
Amo

(10) Patent No.: US 9,342,944 B2
(45) **Date of Patent: *May 17, 2016**

(54) PAPER-SHEET STORING/FEEDING MACHINE, PAPER-SHEET HANDLING MACHINE AND METHOD FOR STORING PAPER SHEETS

(75) Inventor: Toshiyuki Amo, Himeji (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/702,687

(22) PCT Filed: Jun. 7, 2010

(86) PCT No.: PCT/JP2010/059628

§ 371 (c)(1),
(2), (4) Date: Dec. 7, 2012

(87) PCT Pub. No.: WO2011/155019

PCT Pub. Date: Dec. 15, 2011

(65) Prior Publication Data

US 2013/0081922 A1 Apr. 4, 2013

(51) Int. Cl.
*G07F 7/00* (2006.01)
*G07D 13/00* (2006.01)
(Continued)

(52) U.S. Cl.
CPC ..... *G07D 13/00* (2013.01); *B65H 29/006* (2013.01); *G07D 11/0006* (2013.01); *G07F 19/20* (2013.01); *B65H 2301/41912* (2013.01); *B65H 2701/1912* (2013.01); *G07D 11/0024* (2013.01)

(58) Field of Classification Search
CPC ..... B65H 29/006; B65H 2301/41922; B65H 2301/4191; B65H 2701/1932; B65H 5/28; G07D 11/0012; G07D 11/0024; G07D 11/0027; G07D 11/0033
USPC ..... 194/206, 207; 209/534; 242/421.4, 421, 242/410, 412, 413, 412.1, 528; 271/3.01, 271/176, 216, 111, 199; 270/58.01, 60; 235/379; 382/135
See application file for complete search history.

(56) References Cited

U.S. PATENT DOCUMENTS 4,697,400 A * 10/1987 Gerber ..... 53/118
4,793,566 A * 12/1988 Honegger ..... 242/528
(Continued)

FOREIGN PATENT DOCUMENTS

JP 11-224362 8/1999
WO WO 2007068911 A1 6/2007
(Continued)

OTHER PUBLICATIONS

English Abstract of WO2009/034725 A1.*
(Continued)

*Primary Examiner* — Jeffrey Shapiro
(74) *Attorney, Agent, or Firm* — Renner, Kenner, Greive, Bobak, Taylor & Weber

(57) ABSTRACT

In order to prevent the paper sheets from being wound around the winding roller, unevenly, in substantially the same position, the paper-sheet storing/feeding machine includes at least one tape, a winding roller, to which one end of the tape is attached, and which is configured to wind and rewind the paper sheets together with the tape, a reel, to which the other end of the tape is attached, and which is configured to wind and rewind the tape relative to the winding roller, a driving source configured to rotate the winding roller, a sensor configured to detect each paper sheet transported thereto, and, a control unit configured to implement a control, each time the transported paper sheet is detected, in which the driving source is controlled to decelerate the winding roller after accelerating the winding roller in a winding direction with the detection of the transported paper sheet by the sensor, and configured to control the driving source, in order to change the length of the tape used for storing one paper sheet, thereby to control a storing pitch of the stored paper sheets to be any one of at least two kinds of storing pitches, when storing the transported paper sheet.

9 Claims, 16 Drawing Sheets

(51) Int. Cl.

| | |
|---|---|
| ***B65H 29/00*** | (2006.01) |
| ***G07F 19/00*** | (2006.01) |
| *G07D 11/00* | (2006.01) |

(56) References Cited

U.S. PATENT DOCUMENTS

| | | | | |
|---|---|---|---|---|
| 4,915,371 | A * | 4/1990 | Quinton | 271/280 |
| 6,371,473 | B1 * | 4/2002 | Saltsov et al. | 271/3.01 |
| 6,669,136 | B2 * | 12/2003 | Niioka et al. | 242/528 |
| 6,969,064 | B2 * | 11/2005 | Ichikawa et al. | 271/216 |
| 7,780,111 | B2 * | 8/2010 | Elbel | 242/528 |
| 8,162,308 | B2 * | 4/2012 | Kobayashi et al. | 270/60 |
| 8,302,757 | B1 * | 11/2012 | Angus et al. | 194/206 |
| 2001/0022258 | A1 | 9/2001 | Satou et al. | |
| 2002/0113160 | A1 * | 8/2002 | Niioka et al. | 242/528 |
| 2003/0155704 | A1 * | 8/2003 | Polidoro et al. | 271/216 |
| 2005/0017428 | A1 * | 1/2005 | Ichikawa et al. | 271/3.14 |
| 2009/0134262 | A1 * | 5/2009 | Elbel | 242/390.2 |
| 2010/0133737 | A1 * | 6/2010 | Cismpi et al. | 271/3.19 |
| 2010/0219580 | A1 * | 9/2010 | Hamasaki et al. | 271/265.01 |
| 2011/0093116 | A1 * | 4/2011 | Nunn | 700/219 |
| 2013/0081922 | A1 * | 4/2013 | Amo | 194/206 |

FOREIGN PATENT DOCUMENTS

| | | | | |
|---|---|---|---|---|
| WO | WO2009034725 | A1 * | 3/2009 | B65H 29/006 |
| WO | WO 2009/147736 | A1 | 12/2009 | |

OTHER PUBLICATIONS

EP Search Report (Application No. 10852859.7—PCT/JP2010/059628) (5 pages dated Mar. 28, 2014).

* cited by examiner

| NUMBER OF STORED BANKNOTES (SHEETS) | WAITING TIME REQUIRED FOR STARTING THE OPERATION(ms) |
|---|---|
| 0~99 | 138 |
| 100~199 | 138 |
| 200~299 | 131.3 |
| 300~399 | 117.8 |
| 400~499 | 87.2 |

PAPER-SHEET STORING/FEEDING MACHINE, PAPER-SHEET HANDLING MACHINE AND METHOD FOR STORING PAPER SHEETS

BACKGROUND OF THE INVENTION

1. Field of the Invention

The present invention relates to a paper-sheet storing/feeding machine, a paper-sheet handling machine and a method for storing paper sheets, each adapted for storing and feeding the paper sheets by winding and rewinding a tape.

2. Background Art

As the paper-sheet storing/feeding machine adapted for storing and feeding the paper sheets, such as banknotes or the like, one paper-sheet storing/feeding machine (hereinafter referred to as a "tape-type storing/feeding machine") including a winding roller designed for winding the paper sheets together with a tape has been known. With the provision of this machine, the paper sheets respectively fed from a transport path can be wound and stored by a winding operation using the winding roller. Further, the paper sheets can be fed out toward the transport path by a rewinding operation using the winding roller. In order to increase the number of the paper sheets stored in this tape-type storing/feeding machine, it is preferred to increase the length of the tape. In addition, the number of the stored paper sheets can be further increased by shortening the length of each part of the tape not used for holding the paper sheets, among the tape wound around the winding roller.

As the method for winding the tape around the winding roller, one approach designed for winding the tape, successively, at a speed controlled to be substantially the same as a transport speed of the paper sheets, has been known. It is true that this approach enables the paper sheets to be stably wound with a relatively simple control operation. However, such an approach is not so advantageous for increasing the number of the stored paper sheets, because the tape is always wound even in the period of time during which no paper sheets are transported.

Another approach designed for intermittently winding the tape has been known (e.g., see Patent Document 1). In this approach, the winding roller is driven to start the winding operation for the tape once the paper sheets are detected to be transported to the winding roller, while the winding roller is operated to stop the winding operation for the tape during the period of time in which no paper sheets are transported to the winding roller.

In the approach for successively winding the tape, the transport pitch for the paper sheets transported to the winding roller is reflected in the storing pitch for the paper sheets stored in or around the winding roller. Therefore, when the transport pitch is constant, the storing pitch is also constant. Meanwhile, in the approach for intermittently winding the tape, the winding roller is started at fixed start timing once the paper sheets are detected to be transported thereto. Thus, the storing pitch is kept nearly constant, regardless of the transport pitch. Accordingly, in both of such approaches, when the paper sheets and tape are wound around the winding roller, the outer shape of the winding roller including such paper sheets and tape is substantially circular, except for some particular cases.

For instance, "the particular case" means herein a case in which the storing pitch is constant and in which the outer-circumferential length of the winding roller including the tape is substantially the same as n times (n is a natural number) as long as the storing pitch. In such a case, for instance, as shown in FIG. 19, the paper sheets tend to be wound around the winding roller, unevenly, in substantially the same position or positions. More specifically, FIG. 19(*a*) shows one case in which the outer-circumferential length of the winding roller is substantially the same as the storing pitch, and FIG. 19(*b*) shows another case in which the outer-circumferential length of the winding roller is substantially the same as twice as the storing pitch. Further, as used herein, "the same position or positions" means a position or positions, each located or arranged in substantially the same direction, when seen from the center of the winding roller.

Namely, in the case in which the paper sheets are wound as shown in FIG. 19, the outer shape of the winding roller including the paper sheets and tape will not be circular. Therefore, with the rotation of the winding roller, the distance between the winding roller and other parts, such as guides or the like, respectively arranged to surround the outer circumference of the winding roller, will be changed considerably, thus leading to occurrence of a negative effect, such as vibration or the like. Further, in the case as shown in FIG. 19(*a*), the center of gravity of the winding roller including the paper sheets and tape will not be coincident, in position, with the center of rotation of the winding roller, thus causing another negative effect, such as difficulty in controlling the rotation or the like.

By the way, in the approach for successively winding the tape, the aforementioned particular case in which the outer-circumferential length of the winding roller including the tape is substantially the same as n times (n is the natural number) as the storing pitch can be avoided, by altering the storing pitch by changing the transport pitch and/or winding speed of the paper sheets. (e.g., see Patent Document 2).

However, in the approach for intermittently winding the tape, the paper sheets respectively transported to the winding roller are wound once they are detected one by one. Therefore, the storing pitch is not changed even in the case in which the transport pitch and/or winding speed is altered. As such, the occurrence of the negative effect as described above cannot be avoided.

REFERENCES OF THE PRIOR ART

Patent Document 1: JP11-224362A
Patent Document 2: W02009/147736A

SUMMARY OF THE INVENTION

Problem to be Solved by the Invention

It is an object of the present invention to provide the paper-sheet storing/feeding machine, which is adapted for winding the paper sheets transported thereto, with detection for such paper sheets, and which is capable of preventing the paper sheets from being wound around the winding roller, unevenly, in substantially the same position or positions. Another object of the present invention is to provide the paper-sheet handling machine and method for storing the paper sheets, each related to the paper-sheet storing/feeding machine of this invention.

Means for Solving the Problem

According to one aspect of the present invention, a paper-sheet storing/feeding machine configured to store therein paper sheets transported thereto and feed out the stored paper sheets therefrom to the exterior, includes at least one tape, a winding roller, to which one end of the tape is attached, and which is configured to wind and rewind the paper sheets together with the tape, a reel, to which the other end of the tape is attached, and which is configured to wind and rewind the tape relative to the winding roller, a driving source configured to rotate the winding roller, a sensor configured to detect each paper sheet transported thereto, and a control unit configured to implement a control, each time the transported paper sheet is detected, in which the driving source is controlled to decelerate the winding roller after accelerating the winding roller in a winding direction, and configured to control the driving source, in order to change the length of the tape used for storing one paper sheet, thereby to control a storing pitch of the stored paper sheets to be any one of at least two kinds of storing pitches, when storing the transported paper sheet. This makes it possible to switch the storing pitch of the paper sheets.

According to one aspect of the present invention, in the paper-sheet storing/feeding machine, the storing pitch includes a first storing pitch and a second storing pitch, and the control unit switches the storing pitch from the first storing pitch to the second storing pitch, when a predetermined condition is satisfied. This makes it possible to switch two kinds of storing pitches.

According to one aspect of the present invention, in the paper-sheet storing/feeding machine, the storing pitch is switched, under the predetermined condition that one paper sheet stored later is stored around the winding roller in substantially the same position as another paper sheet stored previously, and is overlapped with the paper sheet stored previously. This makes it possible to switch the storing pitch when the paper sheets are wound around the winding roller, unevenly, in substantially the same position.

According to one aspect of the present invention, in the paper-sheet storing/feeding machine, the predetermined condition is that the outer-circumferential length of the winding roller including the paper sheets and tape respectively wound around the winding roller is in a range that is predetermined based on the length corresponding to an integral multiple of the first storing pitch. This makes it possible to switch the storing pitch when the number of stored paper sheets is within the range where the paper sheets are wound around the winding roller, unevenly, in substantially the same position.

According to one aspect of the present invention, in the paper-sheet storing/feeding machine, the control unit judges whether or not the outer-circumferential length of the winding roller is in the predetermined range, based on the number of the paper sheets wound per rotation of the winding roller. This makes it possible to switch the storing pitch when n (n is a natural number) paper sheets are wound around the winding roller per revolution and the paper sheets are wound around the winding roller, unevenly, in substantially the same position.

According to one aspect of the present invention, in the paper-sheet storing/feeding machine, the control unit judges whether or not the outer-circumferential length of the winding roller is in the predetermined range, based on a relationship that is obtained, in advance, between the number of the paper sheets wound around the winding roller and the judgment result on whether or not the predetermined condition is satisfied, as well as based on the number of the paper sheets actually wound around the winding roller. This makes it possible to judge whether or not the outer-circumferential length of the winding roller is the length where the paper sheets are wound around the winding roller, unevenly, in substantially the same position, and to switch the storing pitch.

According to one aspect of the present invention, in the paper-sheet storing/feeding machine, the control unit controls the storing pitch by controlling at least one of a winding length of a part of the tape corresponding to a part of the interval between one paper sheet and another paper sheet that is stored before the one paper sheet, and the winding length of another part of the tape corresponding to another part of the interval between the one paper sheet and still another paper sheet that is stored after the one paper sheet, among the length of the tape used for winding the one paper sheet. This makes it possible to prevent the paper sheets from being wound around the winding roller, unevenly, in substantially the same position by shifting the winding position of the paper sheets on the winding roller.

According to one aspect of the present invention, a paper-sheet handling machine includes the paper-sheet storing/feeding machine. This makes it possible to handle the paper sheets with switching the storing pitch of the paper sheets.

According to one aspect of the present invention, a method for storing paper sheets uses a paper-sheet storing/feeding machine. The machine includes at least one tape, a winding roller, to which one end of the tape is attached, and which is configured to wind and rewind the paper sheets together with the tape, a reel, to which the other end of the tape is attached, and which is configured to wind and rewind the tape relative to the winding roller, a driving source configured to rotate the winding roller, and a sensor configured to detect each paper sheet transported thereto. The method includes detecting each paper sheet by using the sensor, accelerating the winding roller in a winding direction by using the driving source, decelerating the winding roller in the winding direction by using the driving source, and changing the length of the tape used for storing one paper sheet in order to allow the paper sheets to be stored with any one of at least two kinds of storing pitches. This makes it possible to prevent the paper sheets from being wound around the winding roller, unevenly, in substantially the same position.

Effect Of The Invention

Accordingly, the present invention can provide a new approach, which is adapted for winding the paper sheets transported to the paper-sheet storing/feeding machine or the like, with detection for such paper sheets, and which is capable of preventing the paper sheets from being wound around the winding roller, unevenly, in substantially the same position or positions.

DETAILED DESCRIPTION OF THE INVENTION

Hereinafter, several embodiments of the present invention will be described with reference to the drawings.

(First Embodiment)

Figure 1:
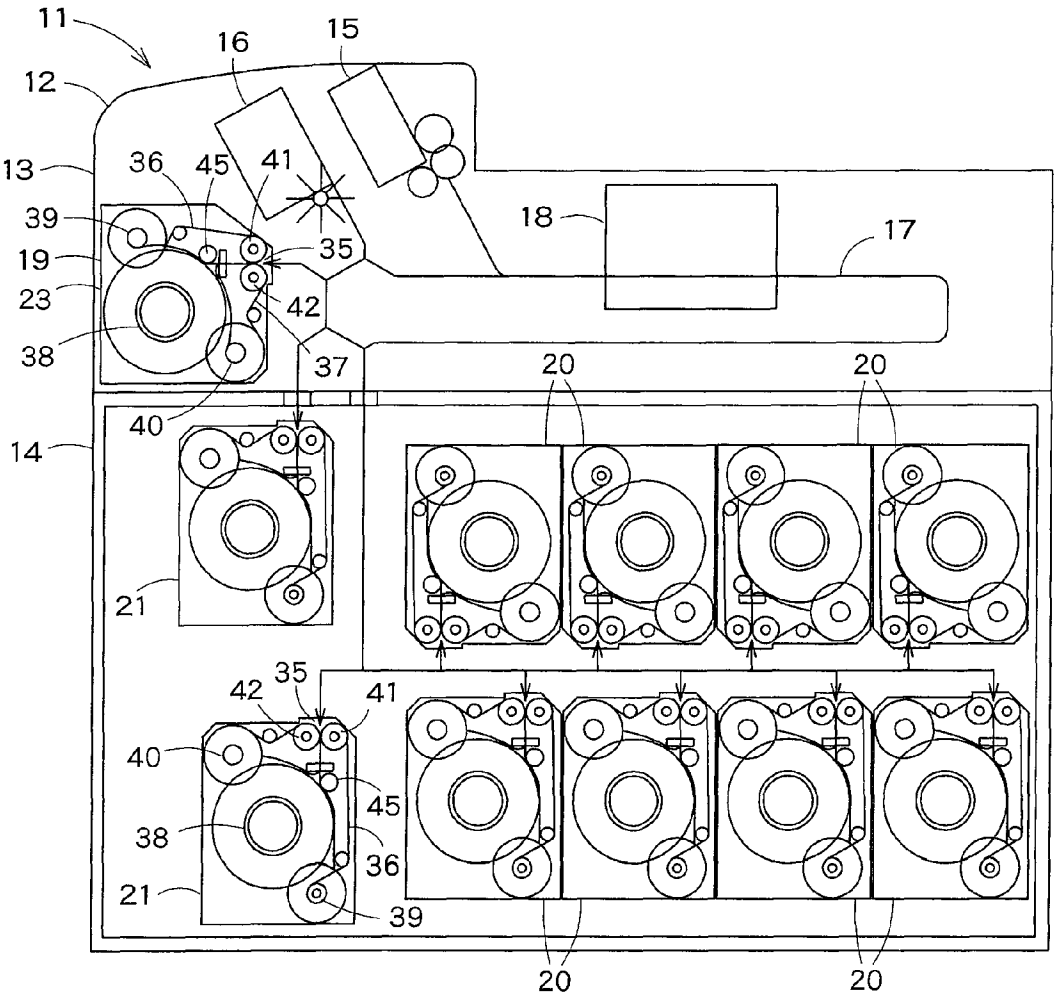
FIG. 1 is a diagram schematically showing the paper-sheet handling machine related to a first embodiment of the present invention.

FIG. 1 shows one exemplary banknote handling machine 11 that will be described herein as the paper-sheet handling machine related to the first embodiment of the present invention. It should be appreciated that the paper-sheet handling machine is not limited herein to the banknote handling machine. For instance, the paper-sheet handling machine of the present invention may be applied to any other suitable machine adapted for handling sheet-like articles other than the banknotes, such as checks, vouchers or the like, respectively made of paper and/or resin.

In this embodiment, the banknote handling machine 11 is a banknote deposit/dispense machine designed for depositing and dispensing the banknotes handled as the paper sheets. More specifically, the banknote handling machine 11 includes an upper unit 13 and a lower unit 14, respectively capable of being drawn out from a front face of a body 12.

A depositing unit 15 adapted for depositing the banknotes and a dispensing unit 16 adapted for dispensing the banknotes are respectively located in an upper portion of a front face of the upper unit 13. The depositing unit 15 includes an inlet provided for receiving the banknote, and a banknote feeding mechanism provided for feeding the banknotes, one by one, on a predetermined reception cycle, to a transport unit 17. The dispensing unit 16 includes a stacking mechanism provided for stacking the banknotes, and an outlet.

In the upper unit 13, the transport unit 17 adapted for transporting the banknotes, a recognition unit 18 adapted for recognizing each banknote transported by the transport unit 17 and an escrow unit 19 are located, respectively. The transport unit 17 is designed for transporting the banknotes respectively received from the depositing unit 15, at a predetermined transport speed.

In the lower unit 14, banknote storing units 20 respectively adapted for storing therein the banknotes fed from the transport unit 17, for each denomination of money of such banknotes, and other banknote storing units 21 respectively adapted for storing therein the banknotes fed from the transport unit 17 are located, respectively.

Each of the escrow unit 19 and banknote storing units 20, 21 is constructed by using the banknote storing/feeding machine, which is described herein as the paper-sheet storing/feeding machine adapted for winding and storing therein the banknotes, one by one, separately, as well as adapted for rewinding and feeding out therefrom such stored banknotes, one by one.

The transport unit 17 is constructed by using a belt mechanism and/or a roller mechanism adapted for transporting the banknotes, and includes a loop-shaped transport path capable of transporting the banknotes in both of forward and backward directions. In this case, a transport path extending from the depositing unit 15, another transport path running up to the outlet 16, a storing/feeding transport path provided for the escrow unit 19 and other storing/feeding transport paths respectively provided for the banknote storing units 20, 21 are connected, respectively, with the loop-shaped transport path, via appropriate diversion mechanisms. The transport direction of each banknote handled by the banknote handling machine 11 is set as the long-edge first orientation that is orthogonal to the long edge direction of the banknote. It should be noted that the transport direction of each banknote may be set as the short-edge first orientation.

Figure 2:
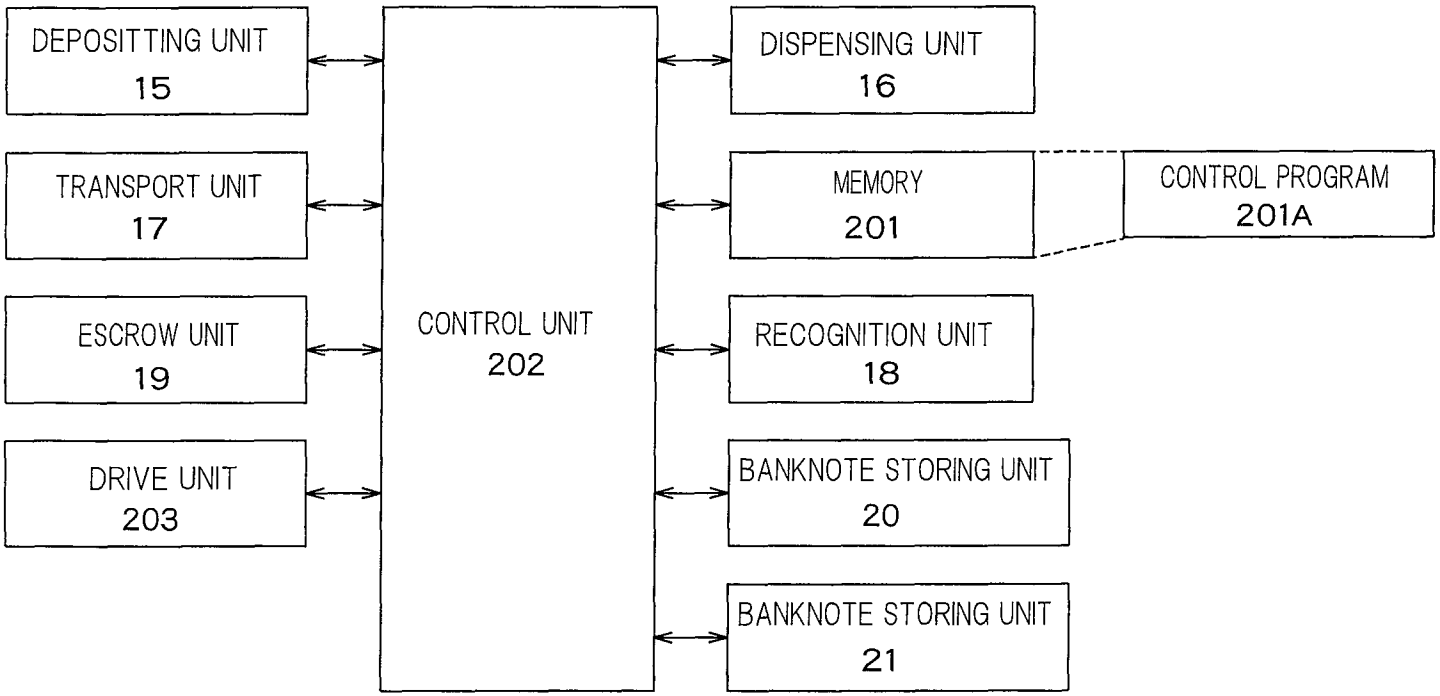
FIG. 2 is a block diagram of one exemplary banknote handling machine related to the first embodiment.

FIG. 2 shows one exemplary block diagram of a control system provided for the banknote handling machine 11 shown in FIG. 1. As shown in FIG. 2, the banknote handling machine 11 includes a memory 201, a control unit 202 and a drive unit 203

The memory 201 is constructed by using a ROM and/or a RAM and adapted for storing therein a control program 201A and other various data. For instance, the memory 201 can serve to store therein the number and/or order of the banknotes respectively stored in the escrow unit 19 and banknote storing units 20, 21, the denomination of money of each stored banknote and the like. Further, the memory 201 can also serve as a working memory used for the control unit 202.

The control unit 202 is connected with the depositing unit 15, dispensing unit 16, transport unit 17, recognition unit 18, escrow unit 19, banknote storing units 20, 21, memory 201 and drive unit 203, in order to control each of such units.

As used herein, "the drive unit 203" is a general term for expressing a drive means provided to the banknote handling machine 11. In this embodiment, the drive unit 203 serves to drive the depositing unit 15, dispensing unit 16, transport unit 17, recognition unit 18, escrow unit 19, banknote storing units 20, 21 and the like, in accordance with a control command outputted or sent from the control unit 202.

Alternatively, the memory 201, control unit 202 and drive unit 203 may be provided, respectively, for each of the aforementioned units. In this case, each of the aforementioned units is operated under the control of the control unit 202 provided for the banknote handling machine 11, as a higher-ranking control unit. Further, the control unit 202 may be communicated with another control unit (not shown) provided for a higher-ranking machine relative to the banknote handling machine 11.

Upon a depositing process or operation in the banknote handling machine 11, the banknotes respectively put in the depositing unit 15 are taken, one by one, into the banknote handling machine 11, and then transported by the transport unit 17 and recognized by the recognition unit 18, respectively. As a result, each banknote recognized, as a normal banknote, by the recognition unit 18 will be stored or escrowed, one by one, separately, in the escrow unit 19.

Meanwhile, rejected banknotes that are not suitable for a predetermined recognition process performed in the recognition unit 18, due to their overlapped or any other like unwanted condition generated during a transport process, and/or other banknotes recognized as the rejected banknotes by the recognition unit 18 because such banknotes are abnormal and thus cannot be recognized again will be transported to the dispensing unit 16 and then returned to the exterior, respectively.

After a series of processes from an insertion process for putting the banknotes in the depositing unit 15 to an escrow process for escrowing the banknotes in the escrow unit 19 are completed, respectively, when a command for storing the banknotes is outputted, the banknotes escrowed in the escrow unit 19 will be fed out therefrom, one by one, to the transport unit 17, and then recognized by the recognition unit 18, respectively. Thereafter, once the recognition process is ended, the banknotes are transported to and stored in each banknote storing unit 20 corresponding to the denomination of money thereof. However, if the order in which the banknotes are respectively escrowed in the escrow unit 19 is stored in the memory, this recognition process in the recognition unit 18 may be omitted. Meanwhile, when another command for returning the banknotes is outputted, the banknotes escrowed in the escrow unit 19 will be fed out therefrom, one by one, to the transport unit 17, and then transported to the outlet 16 and returned to the exterior.

Overflow banknotes of a certain denomination of money seen at one banknote storing unit 20 that is full of such banknotes can be stored in any one of the banknote storing units 21. Further, the rejected banknotes or the like may also be stored in any suitable one of the banknote storing units 21.

Upon a dispensing process or operation in the banknote handling machine 11, the banknotes stored in a certain banknote storing unit 20 concerning the dispensing process are fed out, one by one, and then transported by the transport unit 17. Thereafter, once recognized as the normal banknotes by the recognition unit 18, such banknotes are dispensed from the dispensing unit 16.

Now, the banknote storing/feeding machine, which is the paper-sheet storing/feeding machine related to one embodiment of the present invention, and which constitutes each of the escrow unit 19 and banknote storing units 20, 21 of the banknote handling machine 11, will be described.

Figure 3:
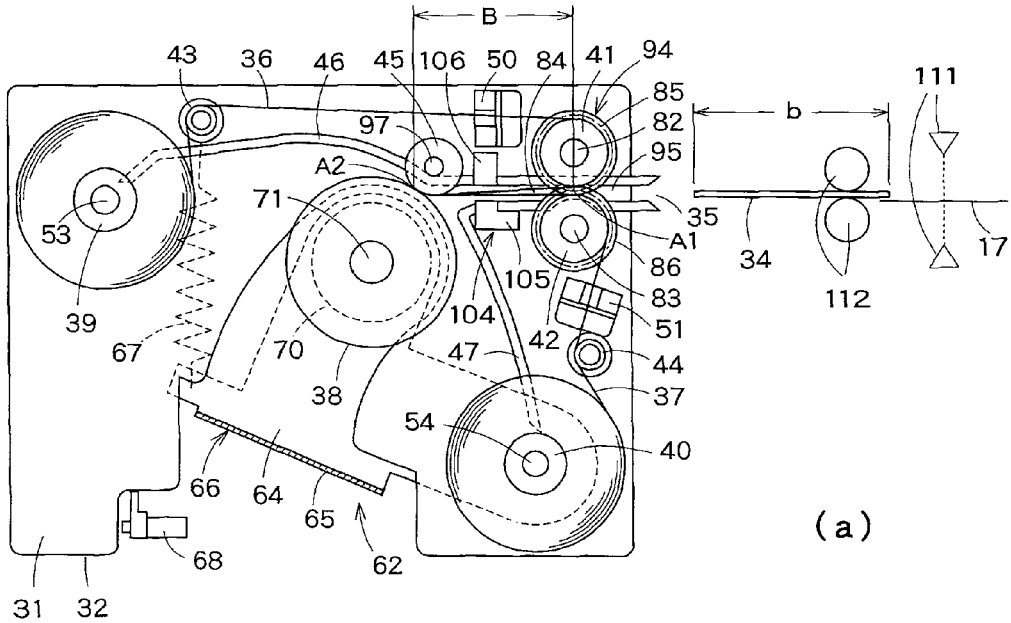
FIG. 3 is a cross section of the banknote storing/feeding machine related to the first embodiment.
Figure 3:
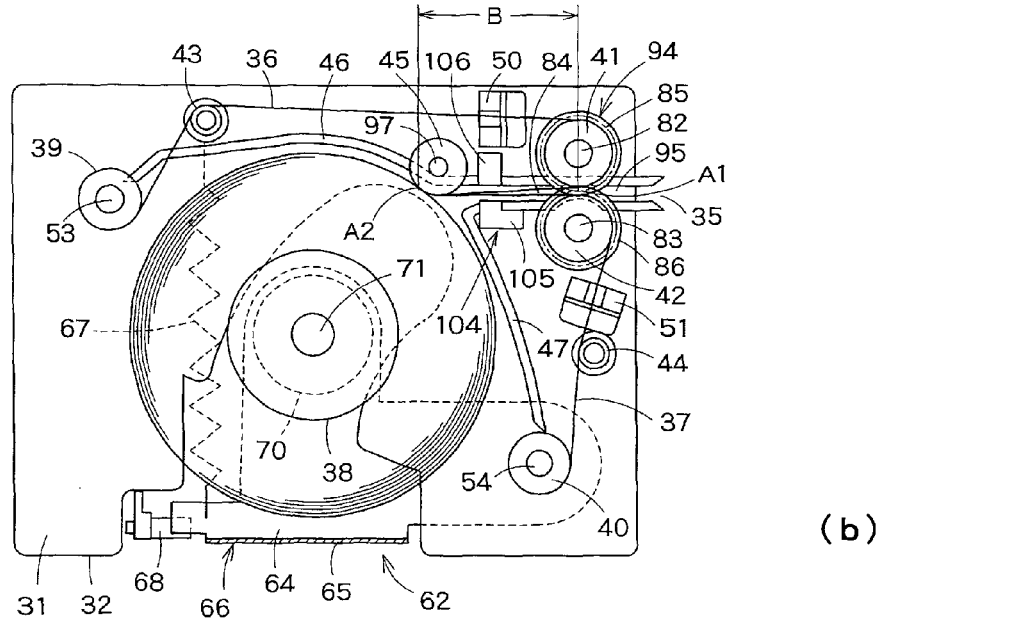

FIG. 3 shows one exemplary cross section of the banknote storing/feeding machine. In this drawing, FIG. 3(*a*) shows one state in which the banknotes are not yet stored in the banknote storing/feeding machine, and FIG. 3(*b*) shows another state in which the banknotes are stored, in a maximum number, in the banknote storing/feeding machine.

This banknote storing/feeding machine has a frame 32 including two side plates 31 respectively located on both sides of the frame 32 (in FIG. 3, only one side plate 31 is shown), and a connection member or members (not shown) provided for connecting the two side plates 31 together. Between the two side plates 31, a storing/feeding slot or opening 35 adapted for disbursing and receiving the banknotes 34 relative to the transport unit 17, one winding roller 38 connected with two tapes 36 and 37, with one end of each tape 36, 37 being attached to the winding roller 38, a reel 39 connected with the tape 36, with the other end of the tape 36 being attached to the reel 39, another reel 40 connected with the tape 37, with the one end of the tape 37 being attached to the reel 40, tape guide rollers 41 and 42, respectively adapted for guiding the tapes 36 and 37, in positions respectively opposite to the storing/feeding slot 35, tape guides 43 and 44, respectively adapted for guiding each movement of the tapes 36, 37 between the reels 39, 40 and the tape guide rollers 41, 42, another guide roller 45 provided as a regulation member adapted for guiding the winding and rewinding operations for the tapes 36, 37 and banknotes 34 relative to the winding roller 38, guide covers 46, 47, respectively adapted for guiding the banknotes 34 from the storing/feeding slot 35 along the outer-circumferential face of the winding roller 38, and the like are arranged, respectively.

Upon a storing process or operation for the banknotes, the tapes 36, 37 are wound around the winding roller 38. With this winding operation for the tapes 36, 37, each banknote 34 transported to the storing/feeding slot 35 will be grasped or held between the two tapes 36, 37 and thus wound and stored around the winding roller 38, together with the tapes 36, 37. Meanwhile, upon a feeding process or operation for the banknotes, the tapes 36, 37 wound around the winding roller 38 are wound by the reels 39, 40, respectively, and thus rewound from the winding roller 38. With this rewinding operation for such tapes 36, 37 relative to the winding roller 38, each banknote 34 grasped or held between the two tapes 36, 37 will be fed out toward the storing/feeding slot 35.

The width of each tape 36, 37 is shorter than the width or length of each banknote 34 in the direction crossing the transport direction, i.e., the length in the long edge direction of each banknote 34. For instance, the width of each tape 36, 37 is set at approximately ⅕ times as long as the length in the long edge direction of each banknote 34. Namely, each banknote 34 is stored, with a central part in the long edge direction of the banknote 34 being grasped or held between the two tapes 36, 37, with both ends in the long edge direction of this banknote 34 being respectively projected out from the two tapes 36, 37. Although a pair of tapes 36, 37 are used in this embodiment, the tapes 36, 37 may be provided, in any suitable number, as needed.

One end region of the tape 36 on the side of the reel 39 and one end region of the tape 37 on the side of the winding roller 38 respectively have some optical transparency equal to or higher than a predetermined level. For instance, such two end regions are transparent, respectively. Meanwhile, the other regions than such two end regions of the tapes 36, 37 are not respectively provided with such optical transparency equal to or higher than the predetermined level. For instance, such regions are opaque, respectively.

A wound-tape-end detection sensor 50 is located between the tape guide roller 41 and the tape guide 43. This sensor 50 is provided for detecting the transparent end region of the tape 36 that will be a terminal end of the tape 36 when the tape 36 is wound around the winding roller 38 (or upon the storing process for the banknotes). Further, a rewound-tape-end detection sensor 51 is located between the tape guide roller 42 and the tape guide 44. This sensor 51 is provided for detecting the transparent end region of the tape 37 that will be a terminal end of the tape 37 when the tape 37 is rewound from the winding roller 38 (or upon the feeding process for the banknotes).

The winding roller 38 is of a cylindrical shape having a diameter greater than the diameter of each reel 39, 40. The winding roller 38 is supported to be optionally moved by a winding-roller drive mechanism 62 that will be described below. With this configuration, the distance between the center of the winding roller 38 and the guide roller 45 can be changed as needed.

The reels 39, 40 are attached to axially middle points of reel shafts 53, 54 via torque limiters (not shown), respectively. Each of the reel shafts 53, 54 is provided to be optionally rotated between the two side plates 31. In this case, a pulley (not shown) is attached to one end of each reel shaft 53, 54 projected out from one side plate 31, with a belt (not shown) being provided between such pulleys. Therefore, the two reel shafts 53, 54 can be rotated together.

Further, each reel shaft 53, 54 is attached to the other side plate 31, via a one-way clutch (not shown), in order to allow each reel shaft 53, 54 to be rotated only in one direction corresponding to a tape-winding direction (or clockwise direction in FIG. 3) of the reels 39, 40 upon the feeding process for the banknotes. Meanwhile, the rotation of each reel 53, 54 in the other direction corresponding to a tape-rewinding direction (or anticlockwise direction in FIG. 3) of the reels 39, 40 upon the storing process for the banknotes is prevented.

The winding-roller drive mechanism 62 supporting the winding roller 38 includes side plate sections 64 respectively located outside relative to the side plates 31 of the frame 32, and a support member 66 in which a connection plate section 65 for connecting the side plate sections 64 is formed. The support member 66 is supported to be optionally swayed, relative to the frame 32, about the reel shaft 54. In this case, the support member 66 is biased in a direction for lessening the distance between the center of the winding roller 38 and the guide roller 45, by each spring 67 provided as a biasing member and located between each side plate section 64 and each corresponding side plate 31 of the frame 32.

Thus, upon the storing process for the banknotes, the support member 66 is swayed to separate the center of the winding roller 38 from the guide roller 45, with increase of the outer diameter of the winding roller 38, as the tapes 36, 37 are respectively wound around the roller 38. Meanwhile, upon the feeding process for the banknotes, the support member 66 is swayed to bring the center of the winding roller 30 nearer to the guide roller 45, with decrease of the outer diameter of the winding roller 38, as the tapes 36, 37 are respectively rewound from the roller 38.

A full detection sensor 68 for detecting a state full of the stored banknotes is provided to one side plate 31 of the frame 32. In this case, the full detection sensor 68 can serve to detect a part of one side plate section 64 of the support member 66, when the support member 66 reaches a position in which this support member 66 is most swayed (i.e., a point depicted in FIG. 3(*b*)) in a direction for separating the center of the winding roller 38 from the guide roller 45 upon the storing process for the banknotes. For instance, the full detection sensor 68 is a photo-interrupter that is capable of detecting the state full of the stored banknotes when certain light is blocked by the side plate section 64.

Additionally, a motor 70 and a decelerating mechanism (not shown) are located inside relative to the winding roller 38. A shaft 71 is projected out from the decelerating mechanism on one end side of the winding roller 38. This shaft 71 is supported by one side plate section 64 of the support member 66. In this case, the motor 70 is projected out on the other end side of the winding roller 38. This motor 70 is attached to the other side plate section 64 of the support member 66. The winding roller 38 is supported to be optionally rotated by the motor 70 and deceleration mechanism. Namely, the winding roller 38 is rotated when rotation drive force is transmitted to the winding roller 38, via the deceleration mechanism, from one end of a drive shaft (not shown) of the motor 70. The motor 70 is driven by the drive unit 203, in accordance with the control command outputted from the control unit 202. In this case, the control unit 202 controls the motor 70, in order to allow the interval of the banknotes, respectively wound (or stored) around the winding roller 38, to be constant. This control operation will be detailed later.

The other end of the drive shaft of the motor 70 is extending through and projected out from the other side plate section 64 of the support member 66. This drive shaft is attached to each reel shaft 53, 54 via a gear and a proper one-way clutch. With this configuration, when the winding roller 38 is rotated by the motor 70 in the tape-winding direction upon the storing process for the banknotes, the one-way clutch serves to prevent the rotation drive force from being transmitted to each reel 39, 40. Meanwhile, when the winding roller 38 is rotated by the motor 70 in the tape-rewinding direction upon the feeding process for the banknotes, the rotation drive force is transmitted to each reel 39, 40, via the one-way clutch, as such, each reel 39, 40 can be rotated in the tape-winding direction (or clockwise direction in FIG. 3). Further, in this case, the rotation of the motor 70 is transmitted to each reel 39, 40 via the torque limiter, such that the speed of winding the corresponding tape 36 or 37 with the rotation in the winding direction of each reel 39, 40 can be always higher than the speed of rewinding the tape 36 or 37 from the winding roller 38. Therefore, each tape 36, 37 can be wound around the corresponding reel 39 or 40 without any slackness or looseness.

In order to detect and control the rotation of the winding roller 38, a rotation detection unit, such as a rotary encoder or the like, adapted for detecting the amount of rotations of the motor 70 is attached to the drive shaft of the motor 70 that is a part moved together with the winding roller 38. With this configuration, pulses are generated from the rotary encoder with the rotations of the motor 70, and thus the amount of rotations of the motor 70 and/or winding roller 38 driven by the motor 70 can be detected, based on the number of such pulses. For instance, the amount of rotations of the motor 70 is accumulated and recorded, in advance, over a period of time in which the number of the banknotes wound around the winding roller 38 is increased from zero (0) to a certain number corresponding to the state full of the banknotes, and then a proper table is prepared for prescribing a relationship between the accumulated amount of rotations of the motor 70 and the outer diameter of the winding roller 38. In this way, the control unit 202 can obtain a certain outer diameter of the winding roller 38 corresponding to any given accumulated amount of rotations of the motor 70. As such, the length of the wound or rewound tape (i.e., the length of the tape fed in the machine) can be calculated from the so-obtained outer diameter of the winding roller 38 and/or from the amount of rotations of the motor 70. Further, the outer-circumferential speed of the winding roller 38 can be calculated from the outer diameter of the winding roller 38 and the rotation speed of the motor 70. Thus, the control unit 202 can control the rotation speed of the motor 70, such that the outer-circumferential speed of the winding roller 38 (i.e., the feed speed of the tapes) can be adjusted to a target speed.

In place of using the accumulated amount of rotations of the motor 70, the number of the stored banknotes may be used. Namely, the relationship between the number of the stored banknotes and the outer diameter of the winding roller 38 can also be applied in practical control performed by the control unit 202. Alternatively, the relationship, between the accumulated amount of rotations of the motor 70 and/or number of the stored banknotes and the rotation speed of the motor 70 by which the outer-circumferential speed of the winding roller 38 can be adjusted to the target speed, may be used. For more strict control, it is preferred to measure the feed speed and/or feed length of the tapes by using the rotary encoder or the like means attached to each guide 43, 44.

Each tape guide roller 41, 42 is a flanged roller having flanges respectively provided on both sides thereof, and is adapted for guiding the tapes 36, 37, with each position of the tapes 36, 37 being regulated in the width direction. Further, as shown in FIG. 3, the tape guide rollers 41, 42 are rotatably attached to roller shafts 82, 83, respectively provided between the two side plates 31 of the frame 32.

In this case, as shown in FIG. 3, the tapes 36, 37 respectively extend from the reels 39, 40 toward the winding roller 38, via the tape guide rollers 41, 42, while being wound or guided along the tape guide rollers 41, 42, in positions opposite to each other, with a proper gap being provided between such two wound tapes 36, 37. Further, in this case, a space 84 having a substantially triangular shape is provided in the position in which the tapes 36, 37 are respectively wound or guided along the tape guide rollers 41, 42. This space 84 can serve to receive each banknote 34 upon the storing process for the banknotes and allow the received banknote to be grasped and held between the two tapes 36, 37 and then wound around the winding roller 38.

The roller shaft 82 is fixed to both side plates 31 of the frame 32. One transport roller 85 is rotatably supported by the roller shaft 82, in positions on both sides of the tape guide roller 41. This transport roller 85 can serve to transport the banknotes 34.

The roller shaft 83 is rotatably supported relative to both side plates 31 of the frame 32. Another transport roller 86 is attached to the roller shaft 83, in positions on both sides of the tape guide roller 42. This transport roller 86 can serve to transport the banknotes 34, with each banknote 34 being grasped or held between the two transport rollers 85, 86.

Namely, the transport rollers 85, 86 are respectively arranged in a position adjacent to the storing/feeding slot 35. Thus, upon the storing process for the banknotes 34, such transport rollers 85, 86 can serve to grasp or hold threrebetween each banknote 34 transported from the transport unit 17 and then feed the banknote 34 into the gap provided between the two tapes 36, 37. Meanwhile, upon the feeding process for the banknotes 34, the transport rollers 85, 86 can serve to grasp or hold therebetween each banknote 34 rewound from the rewinding roller 38 and fed out from the gap provided between the two tapes 36, 37 and then transport the banknote 34 toward the transport unit 17. Namely, such transport rollers 85, 86 constitutes together one transport path 95 for each banknote 34 that is wound or rewound together with the tapes 36, 37 relative to the winding roller 38.

In the transport path 95, one position between the transport rollers 85 and 86, which is located nearest the winding roller 38 and in which each banknotes 34 is held to be transported between the two rollers 85, 86, is referred to as a "transport-path-side holding position A1", and another position, which is located in the vicinity of the guide roller 45 and in which the tapes 36, 37 are respectively wound around the winding roller 38, with each banknote 34 being held between such wound tapes 36, 37, is referred to as a "winding-roller-side holding position A2". In this case, the guide roller 45 is rotatably supported by a roller shaft 97 fixed to the side plates 31 of the frame 32. Further, in this case, the distance B between the two holding positions A1 and A2 is set to be shorter than the length b in the transport direction of each banknote 34.

The winding-roller mechanism 62 can serve to move the winding roller 38, such that the distance between the center of the winding roller 38 and the holding position A1 is changed, depending on the amount of the tapes respectively wound around the winding roller 38, with the distance B being kept shorter than the length b in the transport direction of each banknote 34.

A banknote detection sensor 104 is provided to the transport path 95 located between the winding roller 38 and the tape guide rollers 41, 42. The banknote detection sensor 104 can serve to detect each banknote 34 passing through this sensor 104 upon the storing or feeding process. The banknote detection sensor 104 includes a sensor body 105 arranged on one side of the transport path 95, and a prism 106 arranged on the other side of the transport path 95 and located in a position opposite to the sensor body 105. The sensor body 105 includes a floodlamp or light emission unit adapted for emitting detection light toward the prism 106, and a light reception unit adapted for receiving the detection light coming from the prism 106. The prism 106 is provided for refracting the detection light emitted from the sensor body 105 and then outputting the refracted light toward the light reception unit. With this configuration, each banknote 34 is detected when the detection light is blocked by this banknote 34.

In this embodiment, the banknote detection sensor 104 is located near the winding roller 38. Therefore, the winding process or operation for each banknote 34 relative to the winding roller 38 is considered and described herein to be started or ended at substantially the same time as a point of time, at which the leading edge or rear end of the banknote 34 is detected by the banknote detection sensor 104. Even in the case in which the banknote detection sensor 104 is located separately at a certain distance from the winding roller 38, the point of time, at which the winding process for each banknote 34 relative to the winding roller 38 is started or ended, can be detected by comparing the distance between the sensor 104 and the roller 38 with the distance that the banknote 34 is transported after the detection thereof.

Another banknote detection sensor 111 is provided to the transport unit 17 for transporting the banknotes toward the storing/feeding slot 35. The banknote detection sensor 111 can serve to detect each banknote 34 passing through this sensor 111. For instance, the banknote detection sensor 111 is an optical sensor adapted for detecting each banknote 34 by emitting and receiving the detection light relative to the banknote 34. Namely, this banknote detection sensor 111 detects each banknote 34 when the detection light is blocked by the banknote 34. Upon the storing process for the banknotes 34, each banknote 34 that has passed through the banknote detection sensor 111 is transported toward the storing/feeding slot 35 by a pair of transport rollers 112. It is noted that the banknote detection sensor 111 can be further used as the aforementioned banknote detection sensor 104.

Next, the operation of the banknote storing/feeding machine of this embodiment will be discussed. Hereinafter, one example in which the storing process is completed when the banknotes 34 are completely wound around the winding roller 38 will be described. However, the completion of the storing process is not limited to the point of time at which the banknotes 34 are completely wound around the winding roller 38. For instance, the storing process may be considered to be completed during a period of time in which the banknotes are being moved from the transport unit 17 toward the banknote storing/feeding machine.

Figure 4:
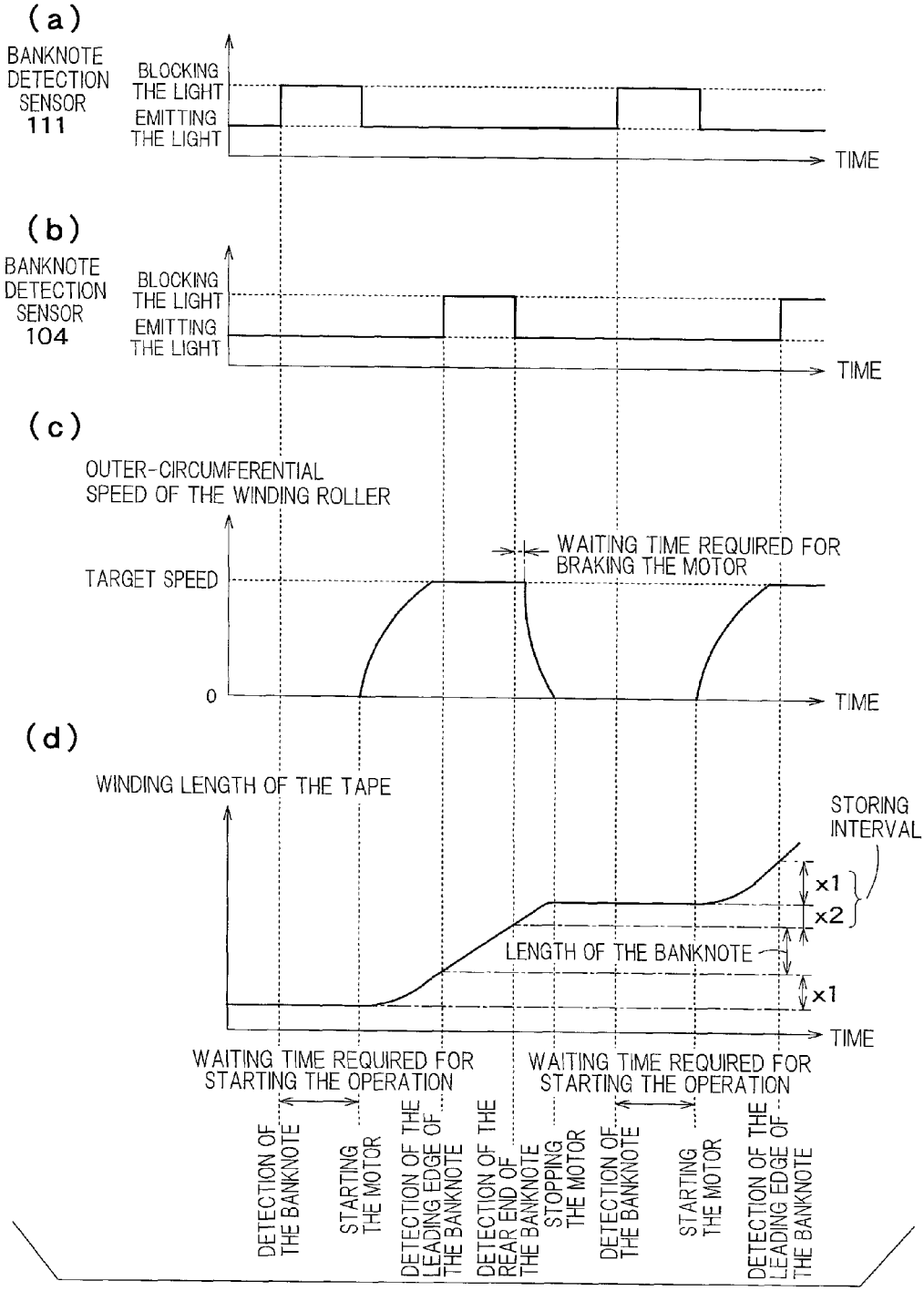
FIG. 4 is a graph provided for showing one example of changes in the outer-circumferential speed of the winding roller as well as in the length of the wound tape, when the banknotes are stored.
Figures 5, 6:
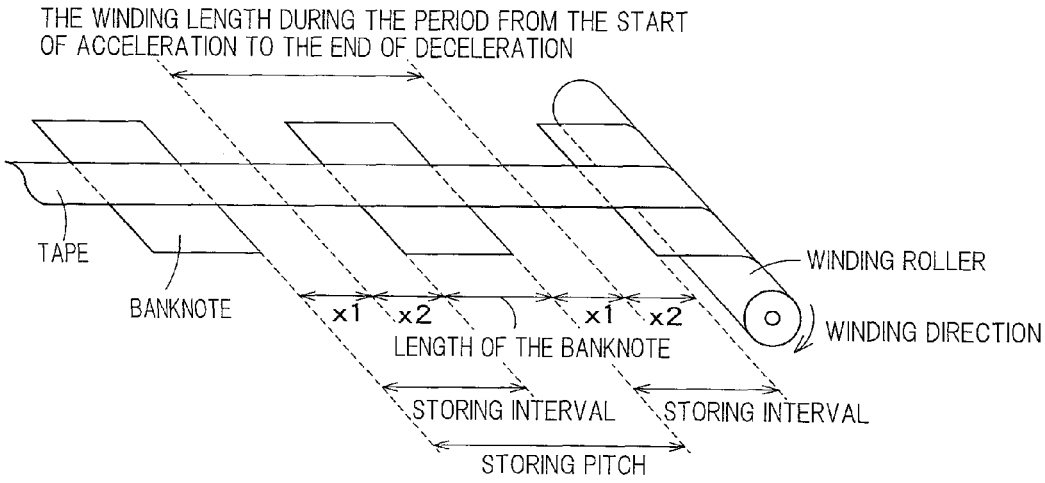
FIG. 5 is a diagram schematically showing one exemplary storing interval of the stored banknotes.
FIG. 6 shows one exemplary table provided for prescribing a relationship between the number of the stored banknotes and the waiting time required for starting the operation.

Now referring to FIGS. 3 to 5, the operation upon the storing process for the banknotes will be described. FIG. 4(*a*) shows a detection result obtained by the banknote detection sensor 111, FIG. 4(*b*) shows another detection result obtained by the banknote detection sensor 104, FIG. 4(*c*) shows the changes in the outer-circumferential speed of the winding roller 38, and FIG. 4(*d*) shows the changes in the length of the tapes wound around the winding roller 38. FIG. 5 is provided for schematically showing the banknotes wound around the winding roller 38, in which the wound (or stored) banknotes are drawn out together with the tapes from the winding roller 38.

When the banknotes 34 are transported by the transport unit 17, the detection light is blocked by each banknote 34, and thus this banknote 34 is detected by the banknote detection sensor 111. Once one banknote 34 is detected by the banknote detection sensor 111, the control unit 202 outputs the control command to the drive unit 203, in order to rotate the motor 70 in the direction corresponding to a banknote storing direction. In this case, the control unit 202 determines the waiting time required for starting the operation, i.e., the time required from the detection of the banknote 34 by using the banknote detection sensor 111 to the start of the rotation (i.e., the start of acceleration) of the motor 70, in such a manner as described later.

With the rotation of the motor 70, the winding roller 38 is rotated in the tape-winding direction to start the winding operation for the tapes 36, 37. Thereafter, the control unit 202 increases the rotation speed of the motor 70. In this way, once the outer-circumferential speed of the winding roller 38 reaches the target speed that will be described later, the rotation speed of the motor 70 will be kept constant (i.e., the end of acceleration).

Thereafter, when the banknote 34 is transported to the storing/feeding slot 35, this banknote 34 is grasped or held, at its leading edge in the transport direction, between the transport rollers 85, 86, and then fed into the gap between the tapes 36, 37. Then, the banknote 34, the leading edge of which has been detected by the banknote detection sensor 104, is grasped or held between the two tapes 36, 37, in the position located in the vicinity of the guide roller 45 and arranged to allow the tapes 36, 37 to be respectively wound around the winding roller 38. In this manner, each banknote 34 is wound and stored, together with the tapes 36, 37, around the winding roller 38.

At this time, the distance B between the transport-path-side holding position A1, in which each banknote 34 is grasped or held between the two transport rollers 85, 86, and the winding roller-side holding position A2, in which the tapes 36, 37 are respectively wound around the winding roller 38, with each banknote 34 being held between such wound tapes 36, 37, is shorter than the length b in the transport direction of the banknote 34. Accordingly, since each banknote 34 is wound around the winding roller 38, while being always held between the two tapes 36, 37, such a banknote 34 can be stored in a stable condition.

Once the banknote detection sensor 104 detects the passage of the banknote 34 (or detects the rear end of the banknote 34) to be stored in or around the winding roller 38, the controller 202 performs a braking control (i.e., the start of deceleration) for the motor 70, in order to stop the motor 70. As used herein, the waiting time required for braking the motor 70 means the time required from the detection of the passage of one banknote 34 by using the banknote detection sensor 104 until the start of braking the motor 70. As a result, the outer-circumferential speed of the winding roller 38 will be gradually lowered, and finally the rotation of the winding roller 38 is stopped (i.e., the end of deceleration). In this way, the storing operation for one banknote 34 is completed. In this case, the product of the outer-circumferential speed of the winding roller 38 and the time required from the detection of the leading edge of the banknote 34 until the detection of the rear end of the same banknote 34 detected by the banknote detection sensor 104 corresponds to the length b in the transport direction of the banknote 34. Thereafter, when the next banknote to be stored around or in the winding roller 38 is detected by the banknote detection sensor 111, the storing operation as described above will be repeated. In this storing operation, the length of a part (or length x1 as shown in FIG. 5) of the tapes 36, 37 wound around the winding roller 38 before one banknote 34 is wound around the winding roller 38, among the length of the tapes 36, 37 wound around the winding roller during a period of time required from the start of acceleration for the winding roller 38 until the end of deceleration for the winding roller 38, corresponds to a part of the interval between the one banknote 34 and the previous banknote wound before the one banknote. Further, the length of another part (or length x2 as shown in FIG. 5) of the tapes 36, 37 wound around the winding roller 38 after the one banknote 34 is wound around the winding roller 38 corresponds to a part of the interval between the one banknote and the next banknote wound after the one banknote.

Namely, as shown in FIG. 5, the length x2 corresponds to the length of the tapes respectively wound around the winding roller 38 during the period of time required from the point of time at which the controller 202 stops the motor 70 once the banknote detection sensor 104 detects the rear end of one banknote until the rotation of the winding roller 38 is stopped, and the length x1 corresponds to the length of the tapes respectively wound around the winding roller 38 during the period of time required from the point of time at which the control unit 202 starts the motor 70 for storing the next banknote until the front end of this banknote is detected by the banknote detection sensor 104. Herein, the total sum of the lengths x1+x2 is referred to as the "storing interval of the banknotes". Therefore, when the length and storing interval of the banknotes are respectively constant, the banknotes are stored with a constant storing pitch. In this embodiment, due to braking force applied to the motor 70 upon the braking control performed by the control unit 202 as well as due to some tension exerted on the tapes 36, 37 from the torque limiter, the winding roller 38 is stopped, such that the length x2 of the tapes will be substantially constant, regardless of the number of the wound banknotes. Nevertheless, in the case in which the length x2 of the tapes is considerably changed depending on the number of the wound banknotes, it is preferred to control the braking strength and/or braking timing, such that the length x2 will be constant.

In the storing process for the banknotes, as the outer diameter of the winding roller 38 including the stored tapes 36, 37 and banknotes is increased, the center of the winding roller 38 is moved to be separated from the guide roller 45, against the biasing force exerted from the spring 67. Thus, even in the case in which the outer diameter of the winding roller 38 is considerably increased, the distance B between the transport-path-side holding position A1 and the winding-roller-side holding position A2 is not substantially changed, thereby to keep a stable storing process or operation for the banknotes.

Now, one method for determining the time required from the detection of each banknote by using the banknote detection sensor 111 to the start of rotation (or acceleration) of the motor 70 (i.e., the waiting time required for starting the operation) will be discussed. In order to avoid occurrence of some negative effect, such as jam or the like, it is desired that the banknotes 34 are respectively wound around the winding roller 38, with the tape-winding speed (or outer-circumferential speed) of the winding roller 38 being controlled to be substantially the same as the transport speed of the banknotes 34. Therefore, the control unit 202 can serve to determine the waiting time required for starting the operation, in consideration of the time required from the start of acceleration of the winding roller 38 to the point of time at which the tape-winding speed reaches a certain target speed substantially the same as the transport speed of the banknotes 34 (hereinafter, this time will be referred to as the "starting-operation time").

Figure 11:
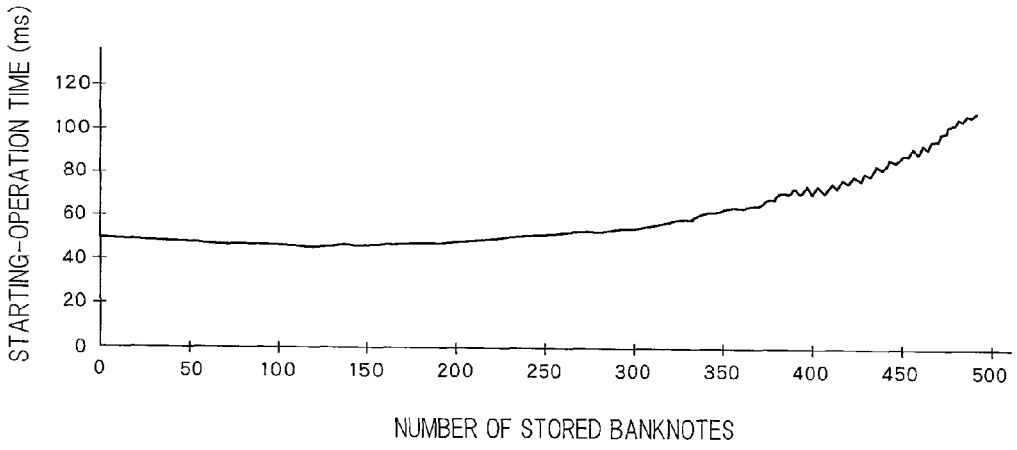
FIG. 11 is a graph provided for showing one example of the relationship between the number of the stored paper sheets and the starting-operation time.

As shown in FIG. 11, the starting-operation time is substantially constant until the number of the stored banknotes reaches about 200 (sheets). However, once the number of the stored banknotes exceeds about 200, the starting-operation time is gradually increased. In this case, when the waiting time required for starting the operation is constant, the aforementioned length x1 of the tapes is decreased as the starting-operation time is increased. Therefore, it is necessary to shorten the waiting time required for starting the operation, with increase of the number of the stored banknotes. To do so, in this embodiment, the waiting time required for starting the operation is determined, such that the considered starting-operation time is lengthened with the increase of the number of the stored banknotes.

More specifically, the waiting time required for starting the operation is obtained, in advance, depending on the number of the banknotes stored around the winding roller 38, and then stored in the memory 201, for example, as the table as shown in FIG. 6. In this example shown in FIG. 6, the maximum number of the banknotes stored in or around the winding roller 38 is set at 500. Further, in view of the result shown in FIG. 11, the waiting time required for staring the operation is set at the same value, for both of the case in which the number of the stored banknotes is from 0 to 99 and the case in which the number of the stored banknotes is from 100 to 199. In the example shown in FIG. 6, although the waiting time required for starting the operation is set, with the number of the stored banknotes being divided in units of 100 sheets, such waiting time may be set, with the number of the stored banknotes being divided in units less than 100 sheets. In either case, the table is prepared, such that the waiting time required for starting the operation is shortened with the increase of the number of the stored banknotes.

Further, the acceleration start timing for the motor 70 is determined to be earlier, with the increase of the number of the stored banknotes. Namely, with the increase of the number of the stored banknotes, the distance between the transport-path-side holding position A1 and the leading edge in the transport direction of each banknote 34 upon the start of acceleration for the motor 70 will be increased.

In this case, the control unit 202 extracts the waiting time required for starting the operation, corresponding to the number of the banknotes stored in the winding roller 38, with reference to the table stored in the memory 201, during the period of time in which the control unit 202 is waiting for the next banknote that will be transported to be stored. Thereafter, once the banknote detection sensor 111 detects the banknote, the control unit 202 starts the acceleration for the motor 70, after the extracted waiting time required for starting the operation has elapsed. It is noted that the control unit 202 may extract the waiting time required for starting the operation after the banknote detection sensor 111 detects the banknote.

Figure 7:
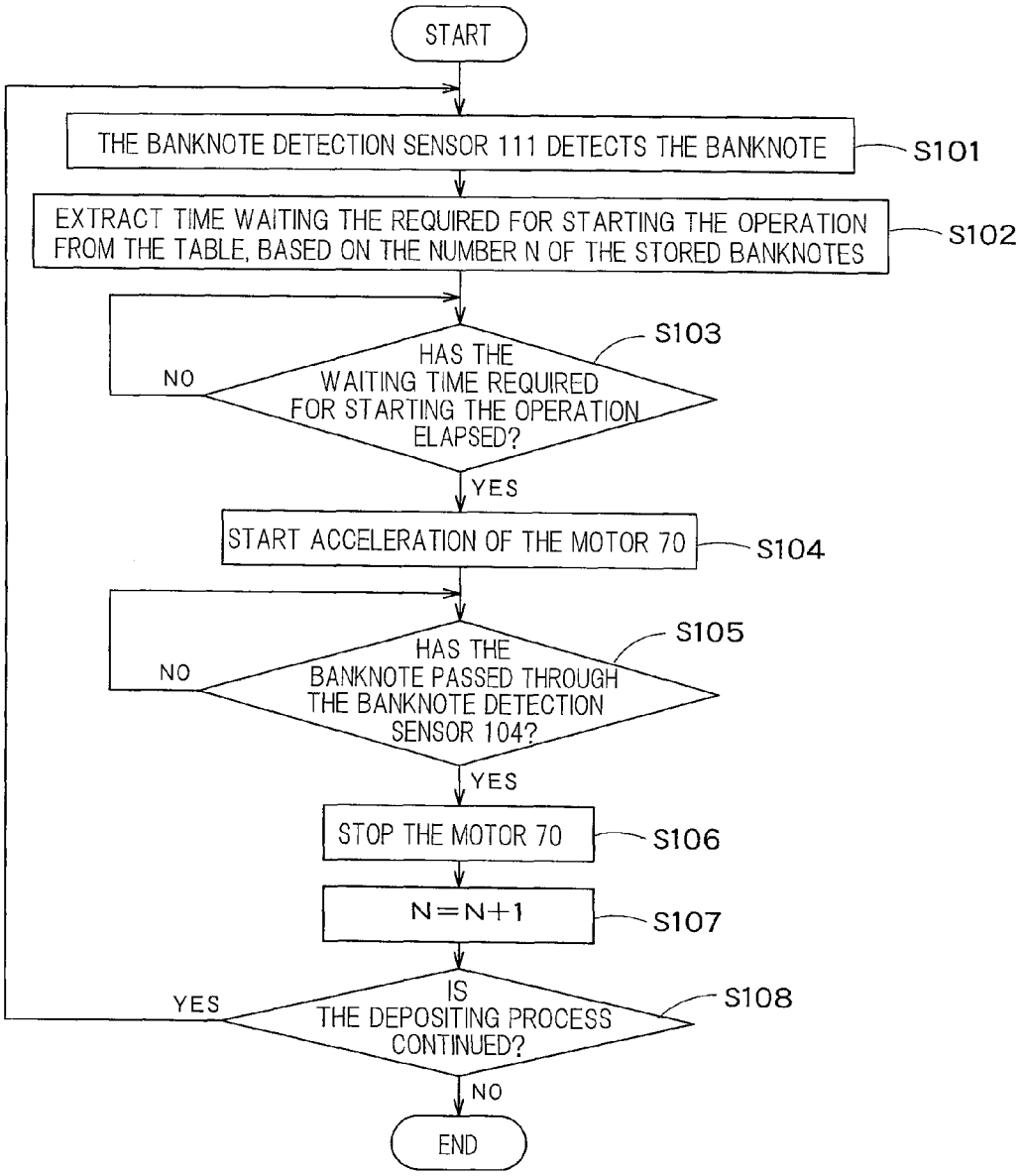
FIG. 7 is a flow chart showing one exemplary method provided for storing the banknotes and related to the first embodiment.

FIG. 7 shows one exemplary flow chart for explaining the method provided for storing the banknotes and related to the first embodiment. In this method, the control unit 202 extracts the waiting time required for starting the operation after the banknote detection sensor 111 detects one banknote.

(Step S101)

The banknote detection sensor 111 detects one banknote. It is noted that this banknote is already taken into the depositing unit 15, recognized by the recognition unit 18 and subjected to other like necessary processes, before this step S101.

(Step S102)

The control unit 202 refers to the table stored in the memory 201 and extracts the waiting time required for starting the operation corresponding to the number N of the banknotes stored around the winding roller 38.

(Step S103)

Once the banknote is detected in the step S101, whether or not the waiting time required for starting the operation and extracted in the step S102 has elapsed is judged. If the waiting time required for starting the operation has elapsed, the procedure goes to a step S104.

(Step S104)

The control unit 202 outputs the control command to the drive unit 203, in order to start the acceleration for the motor 70.

(Step S105)

Once the banknote detection sensor 104 detects the passage of the banknote to be stored around the winding roller 38, the procedure goes to a step S106.

(Step S106)

The control unit 202 outputs the control command to the drive unit 203, in order to stop the motor 70.

(Step S107)

The number N of the banknotes stored around the winding roller 38, which is stored in the memory 201, is counted up by 1.

(Step S108)

If the depositing process is continued, the procedure returns to the step S101, in order to wait for the storing operation for the next banknote.

If the tape-winding speed (or outer-circumferential speed) of the winding roller 38 is lower than the transport speed of the banknotes 34, some negative effect, such as the jam or the like, may tend to occur. Therefore, in the case in which the waiting time required for starting the operation is kept to be constant, this waiting time required for starting the operation is set, such that the tape-winding speed upon the winding operation for each banknote 34 is adjusted to be substantially the same as the transport speed of the banknote 34, even when the number of the stored banknotes is considerably large. Accordingly, during a period of time in which the number of the stored banknotes is relatively small, some waiting time should be left before the banknote 34 is transported to the winding roller 38, even after the tape-winding speed of the winding roller 38 reaches the transport speed for the banknotes 34. Therefore, the tapes 36, 37 are unduly wound around the winding roller 38, so much.

Meanwhile, in this embodiment, the waiting time required for starting the operation is changed, depending on the number of the banknotes stored around the winding roller 38. Thus, each banknote 34 is wound around the winding roller 38, immediately, once the tape-winding speed of the winding roller 38 reaches the transport speed for the banknote 34. Therefore, the banknotes 34 can be wound around the winding roller 38, with a desired interval. In addition, since the tapes 36, 37 are not unduly wound around the winding roller 38, the efficiency in using the tapes can be enhanced, and the number of the stored banknotes can be increased.

Next, the operation upon a feeding process for the banknotes in the banknote storing/feeding machine will be described. First, the motor 70 is rotated in the direction corresponding to a banknote feed direction. Thus, the winding roller 38 is rotated in the tape-rewinding direction, via the deceleration mechanism. At the same time, the reels 53, 54 are respectively rotated in the tape-winding direction. With such rotation of the reels 53, 54, the reels 39, 40 are respectively rotated in the tape winding direction, via the torque limiters, and thus the tapes 36, 37 are wound around the reels 39, 40, respectively. In this case, the tapes 36, 37 are wound around the reels 39, 40, respectively, with constant tension being applied to such tapes.

In this case, due to the rewinding operation for the tapes 36, 37 from the winding roller 38, the banknotes 34 are rewound together with the tapes 36, 37. Thereafter, each banknote 34 rewound from the winding roller 38 is grasped or held between the two transport rollers 86, 87, and then fed toward the transport unit 17 from the storing/feeding slot 35.

At this time, the distance B from the winding-roller-side holding position A2 to the transport-path-side holding position A1 is shorter than the length b in the transport direction of the banknote 34, and thus this banknote 34 is kept to be always held. As such, the banknote 34 can be fed out in the stable condition.

In this operation, once the banknote detection sensor 104 detects the passage of the banknotes 34 corresponding to the number of the banknotes to be fed out, the motor 70 is stopped, and thus the brakes are applied to the winding roller 38 in order to stop its rotation.

When the outer diameter of the winding roller 38 including the wound tapes 36, 37 and banknotes 34 is lessened with the feeding operation for the banknotes 34, the center of the winding roller 38 is moved in the direction for approaching the guide roller 45, by the biasing force exerted from the spring 67. Thus, even though the outer diameter of the winding roller is considerably lessened, the distance B between the transport-path-side holding position A1 and the winding-roller-side holding position A2 is not substantially changed, thereby to provide a stable feeding process or operation for the banknotes.

In this embodiment, as described above, since the waiting time required for starting the operation, i.e., the time required from the detection of one banknote due to the banknote detection sensor 111 to the point of time at which the rotation of the motor 70 is started, is set as a proper time corresponding to the number of the stored banknotes, the storing interval of the banknotes 34 stored around the winding roller 38 can be adjusted to a desired and constant interval. Further, since the approach provided in this embodiment can successfully avoid the case in which the tapes 36, 37 are unduly wound around the winding roller 38, the efficiency in using the tapes can be significantly enhanced.

In the above embodiment, the waiting time is determined, with reference to the table, which is stored in the memory 201, and in which the relationship between the number of the stored banknotes and the waiting time required for starting the operation is prescribed. However, the waiting time required for starting the operation may be obtained by using a proper numerical formula. In this case, a suitable waiting time required for starting the operation can be obtained by substituting a certain number of the stored banknotes into the numerical formula.

Further, in the above embodiment, the waiting time required for starting the operation is determined, depending on the number of the stored banknotes. However, the waiting time required for starting the operation may be determined, depending on a parameter related to the moment of inertia of the winding roller 38 and/or moment generated by the tension of the tapes. For instance, the moment of inertia and/or moment generated by the tension of the tapes is increased, with the increase of the outer diameter of the winding roller 38 including the banknotes and tapes respectively wound around the winding roller 38. Therefore, the waiting time required for starting the operation may be determined, depending on the outer diameter of the winding roller 38. In this case, the outer diameter of the winding roller 38 can be obtained in various ways. For example, the outer diameter of the winding roller 38 can be measured by providing a proper sensor adapted for detecting the distance between the guide roller 45 (or roller shaft 97) and the motor 70 (or shaft 71). Further, the outer diameter of the winding roller 38 can be obtained by providing a contact roller designed to be contacted with the outer-circumferential face of the tapes 36, 37 wound around the winding roller 38, and a suitable sensor adapted for detecting the distance between the contact roller and the motor 70 (or shaft 71). Additionally, the outer diameter of the winding roller 38 can be assumed by providing a further sensor adapted for detecting the length of the tapes 36, 37 respectively rewound from the reels 39, 40, and calculating the outer diameter from the amount of rotations of the winding roller 38 and the detection result obtained from the sensor. Otherwise, as described above, the outer diameter of the winding roller 38 may be obtained by preparing, in advance, one table and/or numerical formula, in which the relationship between the accumulated amount of rotations of the motor 70 and/or number of the stored banknotes and the outer diameter of the winding roller 38 is prescribed, and then referring to this table and/or numerical formula.

(Second Embodiment)

In the above first embodiment, the waiting time required for starting the operation is determined, depending on the number of the banknotes stored around the winding roller 38. However, in this embodiment, certain waiting time required for starting the operation that is used as a standard (i.e., the standard waiting time required for starting the operation) is set, in advance, and then the standard waiting time required for starting the operation is corrected, depending on the storing interval of the banknotes wound around the winding roller 38. In this way, the waiting time required for starting the operation is determined.

The construction of the banknote handling machine related to this embodiment is substantially similar to the construction of the aforementioned first embodiment, and thus will be described with reference to FIGS. 1 to 3. Namely, in this embodiment, the length of the tapes is measured by using the amount of rotations (or number of pulses) of the rotary encoder attached to the motor 70 and the outer diameter of the winding roller 38 including the wound tapes and banknotes, the outer diameter having been obtained by the aforementioned method. For instance, by obtaining the outer diameter of the winding roller 38 from the number of the stored banknotes, the length of the tapes wound per pulse can be known. More specifically, one banknote 34 is detected by the banknote detection sensor 111. Further, this banknote 34 is detected by the banknote detection sensor 104, after the acceleration of the motor 70 is started. Thereafter, the length of the tapes 36, 37 used for winding the one banknote 34 can be obtained from the amount of rotations of the rotary encoder measured until the motor 70 is stopped and the outer diameter of the winding roller 38. In this case, the storing interval is obtained as described above. Namely, because the length x2 of the tapes is controlled to be substantially constant, or otherwise because the length x2 is not steeply changed even in the case in which this length x2 is changed, the storing interval of the banknotes 34 can be considered to be controlled or changed similarly to the length x2. For instance, a value obtained from subtracting the length b in the transport direction of each banknote 34 from the length of the tapes 36, 37 used for winding one banknote 34 can be considered as the storing interval of the banknotes 34.

If one value of the storing interval of the banknotes 34, which is obtained as described above, is greater than a first preset value, the control unit 202 judges that the storing interval is being greater, and corrects the standard waiting time required for starting the operation to be changed on the positive or increment side, and then sets such corrected standard waiting time as the waiting time required for starting the operation for the next banknote to be stored. Namely, by correcting the standard waiting time required for starting the operation to be changed on the positive side, the waiting time required for starting the operation is lengthened. As a result, the time required from the start of acceleration of the motor 70 to the point of time at which the banknote 34 is wound around the winding roller 38 is shortened. Thus, the length of the tapes 36, 37 used for winding one banknote 34 can be shortened, thereby to decrease the storing interval of the banknotes 34.

For instance, the first preset value is set at approximately 1.2 times as a desired storing interval. In this case, the time corrected on the positive side may be constant, or otherwise may be changed optionally, depending on the difference between the value obtained and the first preset value.

Meanwhile, if the value of the storing interval of the banknotes 34, which is obtained as described above, is smaller than a second preset value (<the first preset value), the control unit 202 judges that the storing interval is being smaller, and corrects the standard waiting time required for starting the operation to be changed on the negative or decrement side, and then sets such corrected standard waiting time as the waiting time required for starting the operation for the next banknote to be stored. Namely, by correcting the standard waiting time required for starting the operation to be changed on the negative side, the waiting time required for starting the operation is shortened. As a result, the time required from the start of acceleration of the motor 70 to the point of time at which the banknote 34 is wound around the winding roller 38 is lengthened. As such, the length of the tapes 36, 37 used for winding one banknote 34 can be lengthened, thereby to increase the storing interval of the banknotes 34.

For instance, the second preset value is set at approximately 0.8 times as the desired storing interval. In this case, the time corrected on the negative side may be constant, or otherwise may be changed optionally, depending on the difference between the value obtained and the second preset value. It is preferred that the first and second preset values are suitably changed or altered, respectively, depending on the accuracy in controlling the storing interval.

The storing interval is obtained each time one banknote 34 is stored. The standard waiting time for starting the operation may be corrected, based on the average of the storing intervals (or on the average of the shifts) for a plurality of banknotes 34 already stored around the winding roller 38. Now, referring to the flow chart shown in FIG. 8, one exemplary method for storing the banknotes, with such a correction, will be discussed. In this case, one example is described, in which the standard waiting time required for starting the operation is corrected during the period of time for waiting for the banknote to be stored.

(Step S201)

The storing intervals are obtained, respectively corresponding to a plurality of banknotes (the number of such banknotes is n) respectively wound relatively later, among the banknotes wound around the winding roller 38. Such storing intervals are already stored in the memory 201.

(Step S202)

The average value of the obtained storing intervals is calculated.

(Step S203)

If the calculated average value is greater than the first preset value, the procedure goes to a step S205, or if the calculated average value is equal to or smaller than the first preset value, the procedure goes to a step S204.

(Step S204)

If the calculated average value is smaller than the second preset value, the procedure goes to a step S206, or if the calculated average value is equal to or greater than the second preset value, the procedure goes to a step S207.

(Step S205)

The standard waiting time required for starting the operation is corrected by addition.

(Step S206)

The standard waiting time required for starting the operation is corrected by subtraction.

(Step S207)

The waiting time required for starting the operation corresponding to the next banknote to be stored is determined. In the case in which the standard waiting time required for starting the operation is corrected, the waiting time obtained after the correction is set as the waiting time required for starting the operation. Meanwhile, in the case in which the standard waiting time required for starting the operation is not corrected, this standard waiting time required for starting the operation is set as the waiting time required for starting the operation.

(Step S208)

The banknote detection sensor 111 detects one banknote. It is noted that this banknote is already taken into the depositing unit 15, recognized by the recognition unit 18 and subjected to other like necessary processes, before this step S208.

(Step S209)

Once the banknote is detected in the step S208, whether or not the waiting time required for starting the operation and determined in the step S207 has elapsed is judged. If the waiting time required for starting the operation has elapsed, the procedure goes to a step S210.

(Step S210)

The control unit 202 outputs the control command to the drive unit 203, in order to start the acceleration for the motor 70. Further, the control unit 202 starts a counting operation for counting the number of the pulses of the rotary encoder attached to the motor 70.

(Step S211)

Once the banknote detection sensor 104 detects the passage of the banknote to be stored in or around the winding roller 38, the procedure goes to a step S212.

(Step S212)

The control unit 202 outputs the control command to the drive unit 203, in order to stop the motor 70.

(Step S213)

The control unit 202 calculates the length of the tapes used for winding the banknote (i.e., the storing interval), based on the number of the pulses of the rotary encoder counted during the period of time required from the start of acceleration of the motor 70 until the stop of the winding roller 38 as well as on the outer diameter of the winding roller 38. Then, the calculated storing interval is stored in the memory 201.

(Step S214)

If the depositing process is continued, the procedure returns to the step S201, in order to wait the storing operation for the next banknote.

Figure 8:
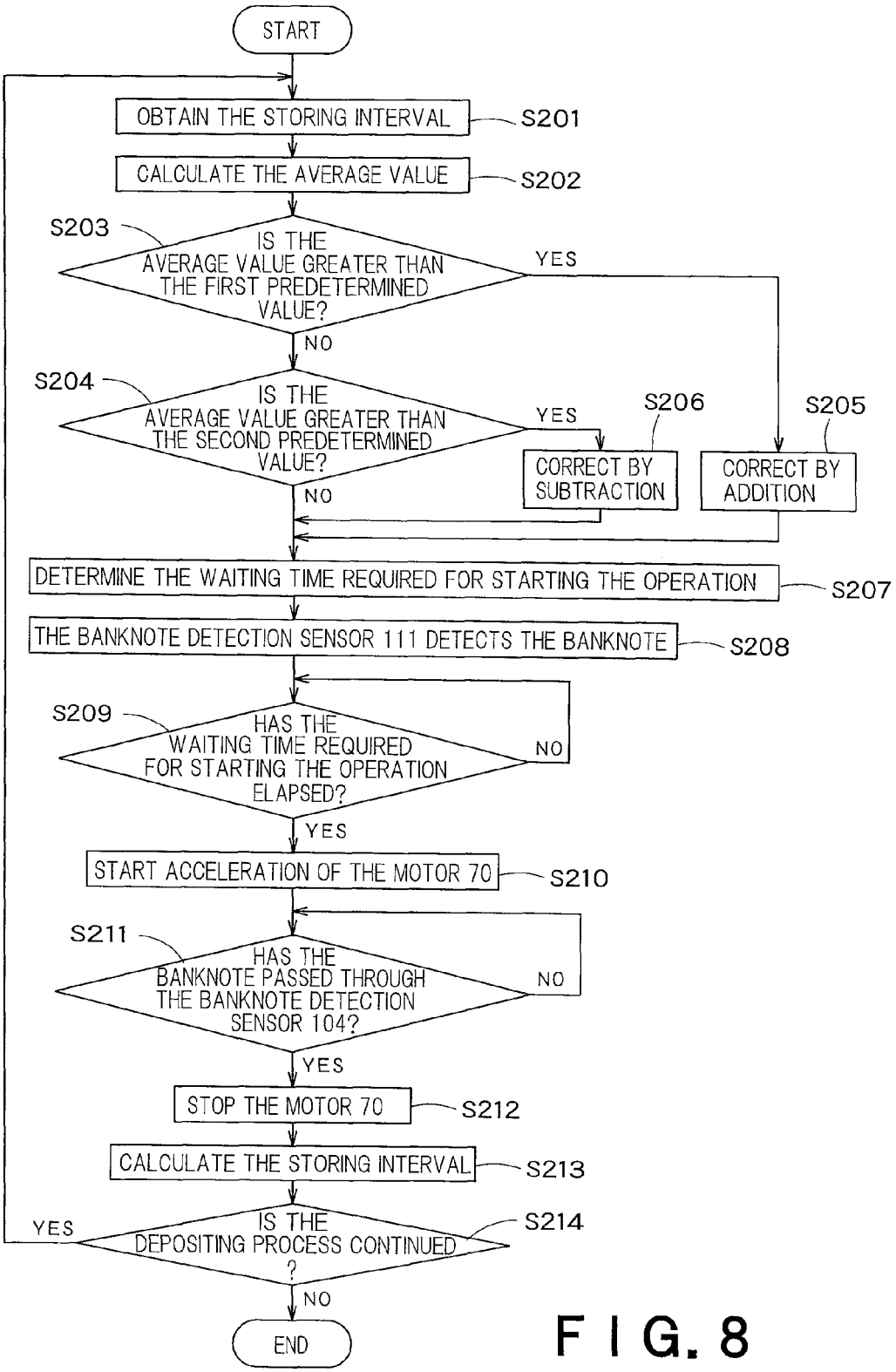
FIG. 8 is a flow chart showing one exemplary method provided for storing the banknotes and related to a second embodiment of the present invention.

In FIG. 8, the correction for the standard waiting time required for starting the operation is performed during the period of time for waiting the transport of the banknote. However, this correction may be performed after the banknote detection sensor 111 detects the banknote to be stored. Namely, the processes respectively performed in the steps S201 through S207 shown in FIG. 8 may be performed during the steps S208 and S209.

Figure 9:
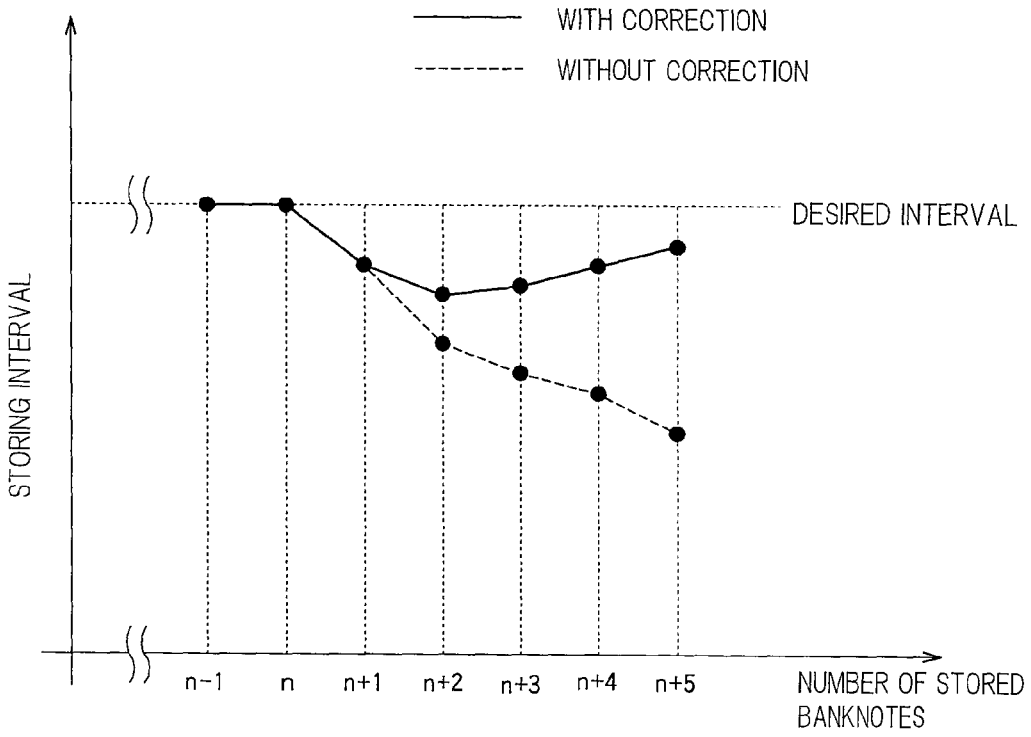
FIG. 9 is a graph provided for showing one example of changes in the storing interval of the banknotes, depending on whether or not standard waiting time required for starting the operation is corrected.

FIG. 9 shows one example of the changes in the storing interval of the stored banknotes, both in the case in which the aforementioned correction for the standard waiting time required for starting the operation is performed, and in the case in which this correction is not performed. More specifically, a solid line designates the case in which the correction is performed, while a dotted or broken line designates the case in which the correction is not performed. In the case in which the correction for the standard waiting time required for starting the operation is not performed, when the number of the stored banknotes exceeds n (n is an integer equal to or greater than 2), the storing interval is gradually lessened, and thus the difference between such a lessened storing interval and the desired storing interval becomes greater. If the storing interval is too lessened, there is a risk that some negative effect, such as chained transportation or the like, may occur.

Meanwhile, in the case in which the correction for the waiting time required for starting the operation is performed as described in this embodiment, when the storing interval is considerably lessened, the standard waiting time required for starting the operation is corrected. This correction can prevent the difference between an actual storing interval and the desired storing interval from being unduly large.

As described above, in this embodiment, since the standard waiting time required for starting the operation is corrected, depending on the storing interval of the banknotes, the storing interval of the banknotes wound around the winding roller 38 can be adjusted to the desired storing interval, thereby to enhance the efficiency in using the tapes.

For instance, in the above second embodiment, the length of the tapes used during the period of time in which one banknote is wound around the winding roller 38 may be obtained by providing a suitable sensor adapted for detecting the length of the tapes rewound from each reel 39, 40, such as by attaching the rotary encoder to each tape guide 43, 44.

Alternatively, both of the length of the tapes wound around the winding roller 38 during the period of time required from the start of acceleration for the motor 70 until the banknote is detected by the banknote detection sensor 104 (i.e., the length of the tapes before the banknote is wound around the winding roller 38) and the length of the tapes wound during the period of time required from the point of time at which the banknote detection sensor 104 detects the passage of the banknote until the winding roller 38 is stopped (i.e., the length of the tapes after the banknote is wound around the winding roller 38) may be obtained, respectively. In other words, the storing interval between the n-th stored banknote and the (n+1)-th stored banknote can be accurately obtained by adding the length of the tapes after the n-th stored banknote is wound around the winding roller 38 and the length of the tapes before the (n+1)-th stored banknote is wound around the winding roller 38.

Further, in the above second embodiment, the correction on the positive or increment side and/or correction on the negative or decrement side is performed for a certain constant standard waiting time required for starting the operation, based on the storing interval. However, in the case in which the standard waiting time required for starting the operation is corrected, the corrected waiting time required for starting the operation may be substituted for the standard waiting time required for starting the operation.

(Third Embodiment)

The construction of the banknote handling machine related to this embodiment is substantially similar to the construction of the aforementioned first embodiment, and thus will be described with reference to FIGS. 1 to 3. In this embodiment, the waiting time required for starting the operation is adjusted in a manner in which the aforementioned first and second embodiments are suitably combined together.

Namely, in this embodiment, the table, in which the relationship between the number of the stored banknotes and the waiting time required for starting the operation is prescribed as shown in FIG. 6, is stored in the memory 201. In this case, the control unit 202 refers to the table stored in the memory 201 and extracts the waiting time required for starting the operation corresponding to the number of the banknotes stored in or around the winding roller 38.

Further, the control unit 202 corrects the waiting time required for starting the operation and extracted from the table, based on the average value of the storing intervals for the plurality of banknotes, respectively wound relatively later, among the banknotes wound around the winding roller 38. For instance, in the case in which the storing interval is greater than the first preset value, the waiting time required for starting the operation and extracted from the table is corrected on the positive or increment side. Meanwhile, in the case in which the storing interval is less than the second preset value (<the first preset value), the waiting time required for starting the operation and extracted from the table is corrected on the negative or decrement side.

Figure 10:
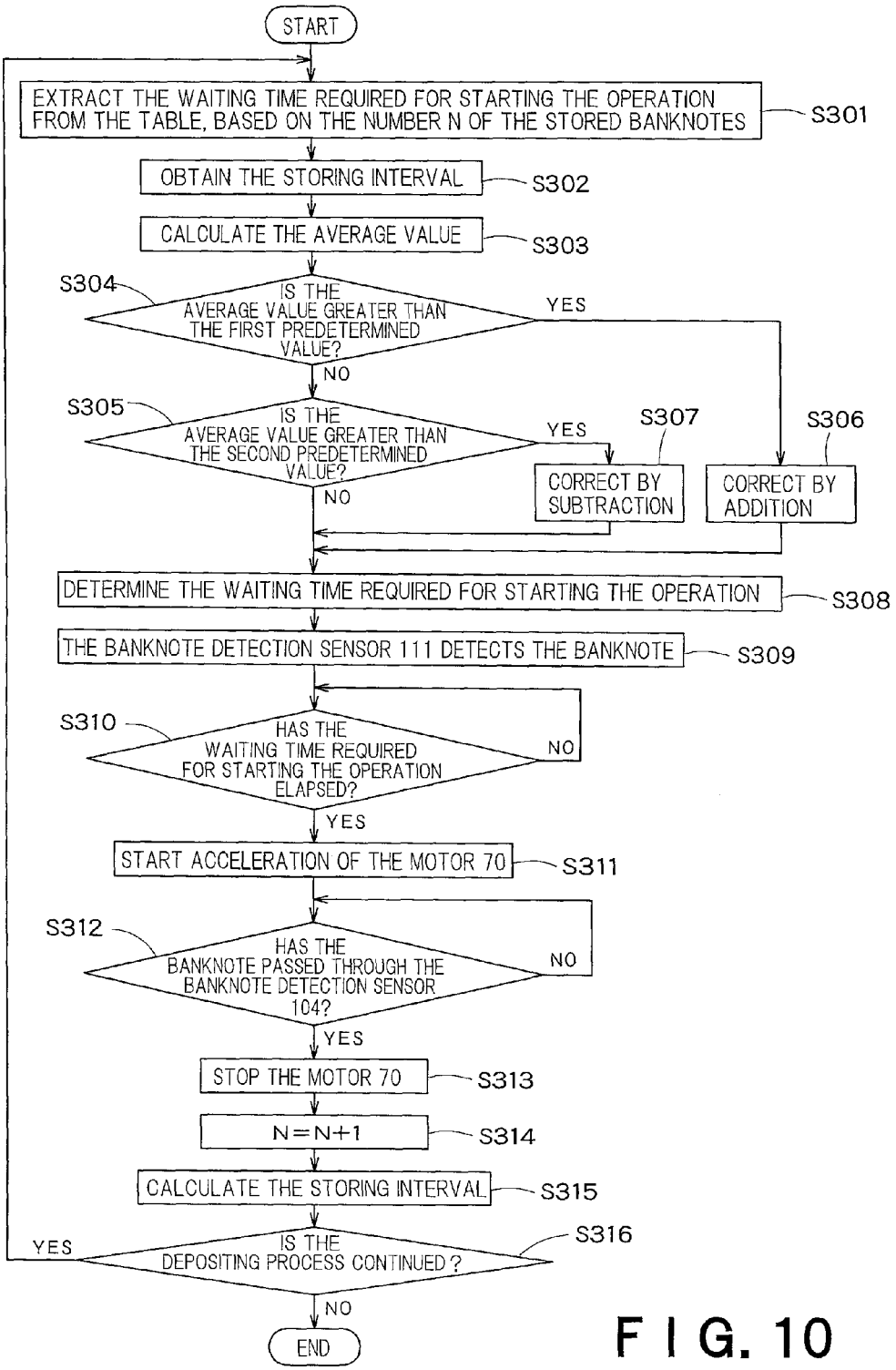
FIG. 10 is a flow chart showing one exemplary method provided for storing the banknotes and related to a third embodiment of the present invention.

Now, referring to the flow chart shown in FIG. 10, one exemplary method provided for storing the banknotes and related to this embodiment is discussed. In this method, one example, in which the extraction and correction for the waiting time required for starting the operation are respectively performed during the period of time for waiting for the banknote to be stored, is described.

(Step S301)

The control unit 202 refers to the table stored in the memory 201 and extracts the waiting time required for starting the operation corresponding to the number N of the banknotes stored in or around the winding roller 38.

(Step S302)

The storing intervals for the plurality of banknotes (the number of the banknotes is N), respectively wound relatively later, among the banknotes wound around the winding roller 38, are obtained, respectively. Such storing intervals are already stored in the memory 201.

(Step S303)

The average value of the obtained storing intervals is calculated.

(Step S304)

If the calculated average value is greater than the first preset value, the procedure goes to a step S306, or otherwise if the calculated average value is equal to or smaller than the first preset value, the procedure goes to a step S305.

(Step S305)

If the calculated average value is smaller than the second preset value, the procedure goes to a step S307, or otherwise if the calculated average value is equal to or greater than the second preset value, the procedure goes to a step S308.

(Step S306)

The waiting time required for starting the operation and extracted in the step S301 is corrected by addition.

(Step S307)

The standard waiting time required for starting the operation and extracted in the step S301 is corrected by subtraction.

(Step S308)

The waiting time required for starting the operation corresponding to the next banknote to be stored is determined. In the case in which the waiting time required for starting the operation and extracted from the table is corrected, the corrected waiting time will be set as the waiting time required for starting the operation.

(Step S309)

The banknote detection sensor 111 detects the banknote. It is noted that this banknote is already taken into the depositing unit 15, recognized by the recognition unit 18 and subjected to other like necessary processes, before this step S309.

(Step S310)

Once the banknote is detected in the step S309, whether or not the waiting time required for starting the operation and determined in the step S308 has elapsed is judged. If the waiting time required for starting the operation has elapsed, the procedure goes to a step S311.

(Step S311)

The control unit 202 outputs the control command to the drive unit 203, in order to start the acceleration for the motor 70. Further, the control unit 202 starts the counting operation for the number of the pulses of the rotary encoder attached to the motor 70.

(Step S312)

Once the banknote detection sensor 104 detects the passage of the banknote to be stored in or around the winding roller 38, the procedure goes to a step S313.

(Step S313)

The control unit 202 outputs the control command to the drive unit 203, in order to stop the motor 70.

(Step S314)

The number N of the banknotes stored around the winding roller 38, which is stored in the memory 201, is counted up by 1.

(Step S315)

The control unit 202 calculates the length of the tapes used for winding the banknote (i.e., the storing interval), based on the number of the pulses of the rotary encoder counted during the period of time required from the start of acceleration of the motor 70 until the stop of the winding roller 38 as well as on the outer diameter of the winding roller 38. Then, the calculated storing interval is stored in the memory 201.

(Step S316)

If the depositing process is continued, the procedure returns to the step S301, in order to wait for the storing operation for the next banknote.

In some cases, when the banknote storing/feeding machine is actually used, unexpected change of load is generated upon preparation of the table stored in the memory 201. When such change of load is generated, there is a risk that the banknotes may not be stored with the desired interval even though the waiting time required for starting the operation and prescribed in the table is used.

Therefore, in this embodiment, the waiting time required for starting the operation corresponding to the number of the stored banknotes is extracted from the table, and then the so-extracted waiting time required for starting the operation is corrected, based on the storing interval of the banknotes. Accordingly, even in the case in which some change of load is generated, an appropriate waiting time required for starting the operation can be set, and thus the storing interval of the banknotes can be adjusted to a desired constant interval. In addition, the efficiency in using the tapes can be enhanced.

In the above first to third embodiments, the time required from the start of acceleration of the winding roller 38 to the point of time at which the tape-winding speed reaches the target speed substantially the same as the transport speed of the banknotes 34 (i.e., the starting-operation time) may be measured. If the time obtained by subtracting the waiting time required for starting the operation and set in a certain case from the time required after the banknote detection sensor 111 detects one banknote until this banknote reaches the winding roller 38 is shorter than the measured starting-operation time, it can be seen that the time is unexpectedly taken for the acceleration of the winding roller 38, due to some change of load or the like. Therefore, in such a case, the waiting time required for starting the operation is corrected to be shorter. With this correction, the banknote can be wound once the tape-winding speed reaches a certain value substantially the same as the transport speed of the banknote 34. Therefore, the occurrence of some negative effect, such as the jam or the like, can be successfully avoided.

In the above first to third embodiments, while the waiting time required for starting the operation is adjusted, the waiting time required for braking the motor may be adjusted. Namely, the waiting time required for braking the motor is adjusted to be longer, as the starting-operation time will be longer with the increase of the number of the stored banknotes. This control can also allow the banknotes to be stored with the desired constant interval, and hence the efficiency in using the tapes can be significantly enhanced. Alternatively or additionally, the relationship between the number of the stored banknotes and the waiting time required for stopping the motor may be prepared in a form of a proper table. Further, a certain standard waiting time required for braking the motor may be corrected, based on the storing interval of the banknotes. Otherwise, such two approaches may be used in a combination. In addition, both of the waiting time required for starting the operation and the waiting time required for braking the motor may be controlled.

For controlling the timing to stop the motor, the timing to detect the leading edge of the banknote may be used in place of the timing to detect the rear end of the banknote, with the operation of the banknote detection sensor 104. In this case, the length of each banknote can be measured by the recognition unit 18 and/or banknote detection sensor 111. Further, in the case in which the banknotes having the same length are stored, a predetermined value for the length of such banknotes may be set in advance.

Additionally, in the above first to third embodiments, while the banknotes are stored with the desired constant interval by controlling the waiting time required for starting the operation, a similar effect can be obtained by controlling the torque of the motor 70. For instance, the torque of the motor 70 upon the acceleration of the winding roller 38 is increased with the increase of the number of the stored banknotes. With this control, the tape-winding speed of the winding roller 38 upon winding the banknotes can also be adjusted to be substantially the same as the transport speed of the banknotes, even in the case in which the number of the stored banknotes is considerably changed. In addition, the length of the tapes 36, 37 used for winding one banknote can be kept substantially constant, as such the banknotes can be stored with the desired constant interval.

Additionally, in the above first to third embodiments, while the timing of the start of acceleration and/or start of braking for the motor 70 is controlled by using certain time, such as the waiting time required for starting the operation and/or waiting time required for braking the motor, a waiting transport amount, i.e., the distance that the banknote is transported, may be controlled. In this case, the transport speed of the banknotes in the transport path 17 is constant, and the following equation: (the waiting transport amount)=(the transport speed)×(the waiting time) is established. Accordingly, the waiting transport amount can be calculated by substituting the waiting time into the above equation, or vice versa. For instance, the distance that the banknote is transported can be obtained by measuring or counting the number of the pulses outputted from the rotary encoder attached to the transport path 17. Therefore, the motor 70 is started, at a point of time that the number of the pulses outputted from the rotary encoder reaches a given value corresponding to the waiting transport amount for starting the operation, once the leading edge of the banknote is detected by the banknote detection sensor of the transport path 17.

For allowing the length of the tapes used for winding one banknote around the winding roller 38 to be constant, various control operations can be employed. For instance, the winding speed during the winding operation for the banknotes may be suitably changed to such an extent that will not causing any interference to the storing process or operation.

(Fourth Embodiment)

Figure 19:
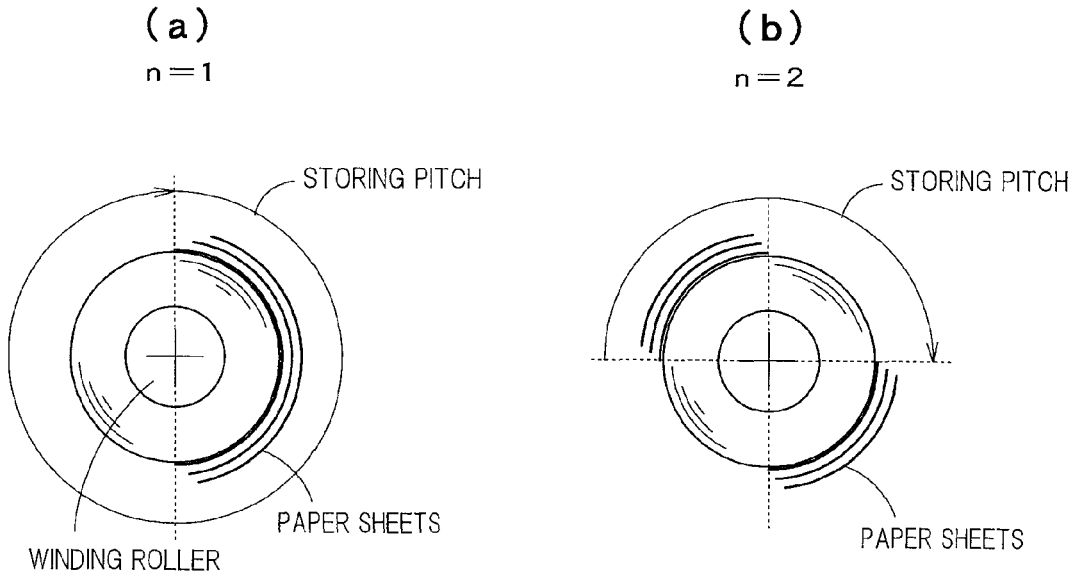
FIG. 19 is a diagram for schematically showing one example in which the paper sheets are wound around the winding roller, unevenly, in substantially the same position or positions.

In the above first to third embodiments, when the banknotes are stored with an equal storing pitch, there is a risk that one banknote may be sometimes wound around the winding roller 38, in substantially the same position as another banknote that is stored around the winding roller 38 before the one banknote, and hence such two banknotes may be substantially overlapped with each other. Herein, the "storing pitch" means the length of the tapes used for winding one banknote, e.g., the length from the leading edge of one stored banknote to the leading edge of the next banknote stored after the one stored banknote. For instance, in the case in which the storing pitch is constant and in which the outer circumferential length of the winding roller 38 including the banknotes and tapes is substantially the same as an integral multiple of the storing pitch, as shown in FIG. 19, the banknotes tend to be wound around the winding roller 38, unevenly, in substantially the same position or positions. As used herein, "substantially the same position or positions around the winding roller 38" means substantially the same direction or directions, when seen from the center of the winding roller 38.

If the banknotes are wound in such a manner, the outer diameter of the winding roller 38 in one position in which such banknotes are wound will markedly differ from the outer diameter thereof in another position in which such banknotes are not wound. Therefore, the outer shape of the winding roller 38 including the banknotes and tapes will not be kept as a circular shape, and will be changed into a non-circular shape, such as an ellipse or the like, thus causing some negative effect, such as the vibration, discordance or positional shift between the center of gravity and the center of rotation of the winding roller 38, or the like.

In order to avoid the occurrence of such a negative effect, it is necessary to prevent the banknotes from being respectively wound around the winding roller 38, unevenly, in substantially the same position or positions. Accordingly, when the control unit 202 checks whether or not the outer shape of the winding roller 38 is non-circular and then detects that the outer shape is non-circular (this detection will be referred to as the "non-circular detection"), the control unit 202 performs a control for allowing the length of the tapes used for winding one banknote to be changed, such that the banknote winding positions around the winding roller 38 can be properly shifted relative to one another. More specifically, the control unit 202 serves to alter the storing interval and thus change the storing pitch, by controlling the length x1 and/or length x2 of the tapes as shown in FIG. 5. In this way, by using a plurality of storing pitches, the banknote winding positions can be shifted, appropriately, relative to one another.

Next, one exemplary method for checking whether or not the outer shape of the winding roller 38 is non-circular will be discussed. In the case in which the banknotes are wound around the winding roller 38, unevenly, in substantially the same position or positions, the number of the banknotes wound around the winding roller 38 per rotation thereof will be an integral number. More specifically, the number of the pulses outputted from the rotary encoder attached to the motor 70 during the storing process for one banknote or a series of banknotes is substantially equal to the number of the pulses outputted during one rotation of the winding roller 38. Therefore, in this embodiment, the non-circular detection for the winding roller 38 is performed by using the number of the pulses outputted from the rotary encoder.

For instance, as shown in FIG. 19(*a*), in the case in which the outer-circumferential length of the winding roller 38 is substantially the same as the length corresponding to twice as the storing pitch, the total sum of the number P1 of the pulses counted during the period of time in which the N-th (N is an integer equal to or greater than 1) banknote is stored and the number P2 of the pulses counted during the period of time in which the (N+1)-th banknote is stored is substantially equal to the number PO of the pulses counted during one rotation of the winding roller 38. This relationship can be expressed by the following numerical formula: $P0/(P1+P2)\approx 1$.

Accordingly, the control unit 202 first counts the number of the pulses outputted from the rotary encoder during the period of time in which one banknote is stored, and then detects that the outer shape of the winding roller 38 is non-circular if the number of the pulses outputted during the period of time in which one or a series of banknotes are stored is in a predetermined range. Herein, this predetermined range is determined, in advance, based on the kinds of banknotes and/or experimental results, as a certain range, in which one banknote or banknotes wound previously and another banknote or banknotes wound later can be considered to be overlapped with one another in substantially the same position.

For instance, in the case of $0.95 \leq P0/P1 \leq 1.05$, as shown in FIG. 19(*a*), the storing pitch is substantially the same as the outer-circumferential length of the winding roller 38. Thus, the outer shape of the winding roller 38 is judged to be non-circular. Further, in the case of $0.95 \leq P0/(P1+P2) \leq 1.05$, since the storing pitch is constant and P1=P2, the outer-circumferential length of the winding roller 38 is substantially twice as the storing pitch. Therefore, the outer shape of the winding roller 38 is judged to be non-circular (in this case, the outer shape is judged to be an ellipse-like shape).

Additionally, in the case in which the number of the pulses counted during the period of time required for storing the (N+2)-th banknote is expressed by P3 and in the case of $0.95 \leq P0/(P1+P2+P3) \leq 1.05$, since the storing pitch is constant and P1=P2=P3, the outer-circumferential length of the winding roller 38 is substantially three times as the storing pitch. Therefore, the outer shape of the winding roller 38 is judged to be non-circular.

Once the control unit 202 detects that the outer shape of the winding roller 38 is non-circular, in the same manner as described above, the control unit 202 determines (or afters) the waiting time required for braking the motor in order to shift or change each position in which the banknotes are wound.

For instance, the control unit 202 controls the waiting time required for braking the motor to be lengthened by a preset time as well as controls the timing to start braking the motor (or braking start timing) to be later, in order to lengthen the length of the tapes 36, 37 (i.e., the length x2 of the tapes) wound during the period of time required from the point of time at which the banknotes 34 are wound until the winding roller 38 is stopped. In this way, the storing pitch can be changed, and thus the winding position for the next banknote to be stored can be suitably shifted, thereby to prevent the outer shape of the winding roller 38 from being non-circular.

In this case, one example, in which the braking start timing for the motor 70 is controlled by using the waiting time required for braking the motor, is described. However, the braking start timing for the motor 70 may be controlled by using the amount of rotations required for braking the motor, which can be expressed by the amount of rotations of the winding rollers 38. In this case, the outer-circumferential speed of the winding roller 38 is constant, and the following equation: (the amount of rotations required for braking the motor)=(the outer-circumferential speed)×(the waiting time required for braking the motor) is established. Accordingly, the amount of rotations required for braking the motor can be calculated by substituting the waiting time required for braking the motor into the above equation, or vice versa. For instance, the amount of rotations of the winding roller 38 can be obtained by measuring or counting the number of the pulses outputted from the rotary encoder attached to the motor 70. Therefore, the braking operation for the motor 70 is started, at a point of time that the number of the pulses outputted from the rotary encoder reaches a certain value corresponding to the amount of rotations required for braking the motor, once the rear end of the banknote is detected by the banknote detection sensor 104.

Figure 12:
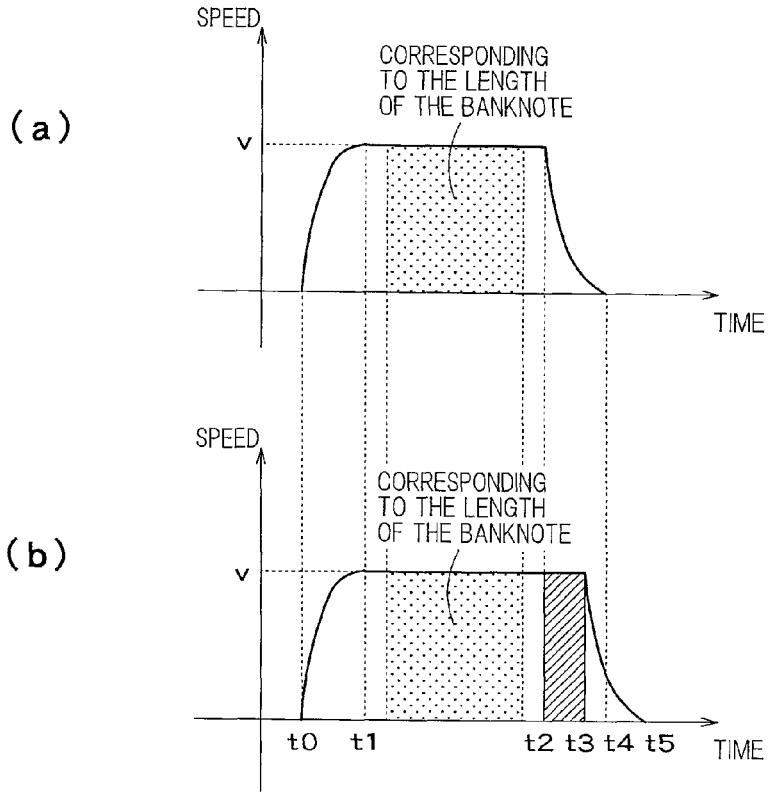
FIG. 12 is a graph provided for showing changes in the rotation speed of the winding roller.

FIG. 12 shows one exemplary graph provided for explaining changes in the rotation speed of the winding roller 38 during the period of time in which one banknote is stored around the winding roller 38. In this drawing, FIG. 12(*a*) shows one exemplary case in which the non-circular shape is not detected, while FIG. 12(*b*) shows another case in which the non-circular shape is detected.

As shown in FIG. 12(*a*), once the banknote detection sensor 111 detects the banknote, the control unit 202 outputs the control command to the drive unit 203, at time t0, in order to rotate the motor 70. As a result, the rotation speed of the winding roller 38 is increased, and reaches a predetermined velocity v corresponding to the transport speed of the banknote, at time t1. Then, the banknote detection sensor 104 detects the passage of the banknote, and the banknote is wound around the winding roller 38. Thereafter, at time t2, the control unit 202 starts the braking operation for the motor 70. Thus, the rotation speed of the winding roller 38 is decreased, and then the rotation of this roller 38 is stopped at time t3. In FIG. 12(*a*), the area of a part surrounded by a line designating the changes of the rotation speed of the winding roller 38 and the horizontal axis (or time axis) corresponds to the length of the tapes used for storing one banknote. This length of the tapes is controlled to allow the length x1 and length x2 of the tapes to be respectively constant, and thus corresponds to a first storing pitch that is used in the case in which the non-circular shape is not detected.

Meanwhile, in the case in which the non-circular shape is detected, as shown in FIG. 12(*b*), the control unit 202 delays the start of braking the motor 70. Namely, the control unit 202 starts the braking operation for the motor 70 at time t4. As a result, the rotation of the winding roller 38 is stopped at time t5. In this case, as shown in FIG. 12(*b*), the length of the tapes used for storing one banknote is lengthened, as compared with the case shown in FIG. 12(*a*), by an amount corresponding to the area of an additional part designated by oblique lines.

Namely, the length of the tapes used for storing one banknote is lengthened by the additional part corresponding to the time for delaying the start of braking the motor 70, thereby to shift the winding position of the next banknote to be stored. This length of the tapes is controlled to allow the length x1 of the tapes to be constant, and thus corresponds to a second storing pitch that is used in the case in which the non-circular shape is detected.

Figure 13:
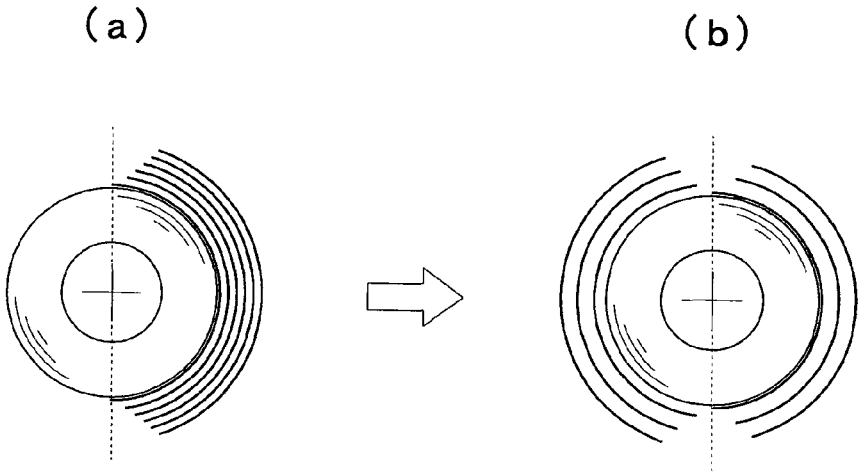
FIG. 13 is a diagram provided for showing one exemplary state in which the banknotes are wound.
Figure 14:
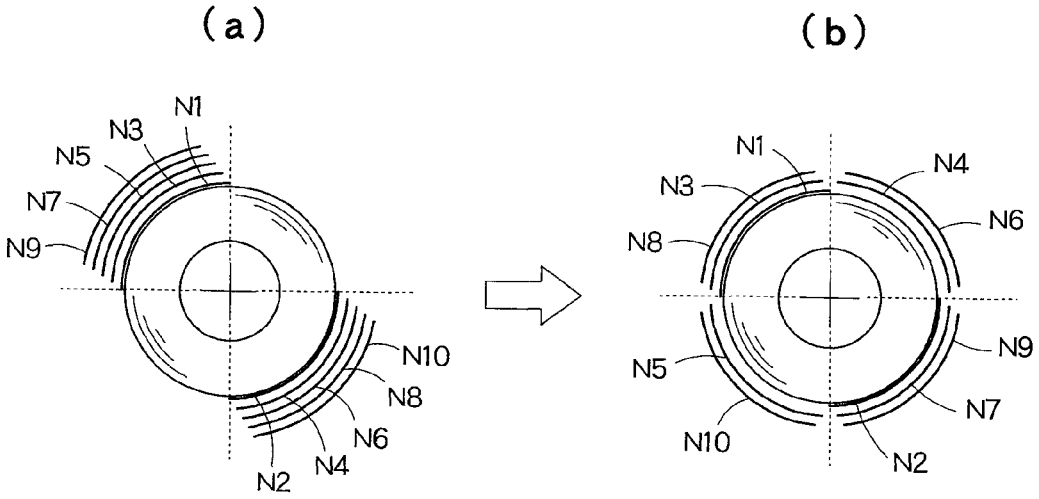
FIG. 14 is a diagram provided for showing another exemplary state in which the banknotes are wound.

If the second storing pitch is not equal to n times (n is a proper integer) as the first storing pitch, it can be optionally determined. In particular, in the case in which the storing interval shown in FIG. 5 is greater than the length of the banknote, when the second storing pitch is lengthened to be longer, by a length substantially the same as the length of the banknote, as compared with the first storing pitch, one banknote can be stored, without being overlapped on another banknote or banknotes stored before the one banknote. Especially, in the case in which the storing interval is slightly longer than the length of the banknote, it is preferred to lengthen the second storing pitch to be longer, by a half of the first storing pitch, as compared with the first storing pitch. In this way, as shown in FIGS. 13 and 14, one banknote can be stored in a part of the storing interval of another banknote stored immediately before the one banknote. Hereinafter, one exemplary case in which the storing interval is slightly longer than the length of the banknote will be described.

In the case in which the outer-circumferential length of the winding roller 38 is substantially equal to n times (n is the integer equal to or greater than 1) as the storing pitch, it is preferred to start the braking operation for the motor 70 after the winding roller 38 is further rotated by a ½ n rotation once the banknote is wound around the winding roller 38. Namely, it is preferred to delay the start of the braking operation, by the time corresponding to a period of time during which the pulses are outputted, from the rotary encoder, in a certain number commensurate with the ½ rotation of the winding roller 38.

For instance, in the case in which the outer-circumferential length of the winding roller 38 is substantially the same as one (n=1) storing pitch, the braking operation for the motor 70 is started after the winding roller 38 is further rotated by the ½ rotation once the banknote is wound around the winding roller 38. However, in the case in which such an alteration for the waiting time required for braking the motor is not performed, the banknotes would be wound around the winding roller 38, unevenly, in substantially the same position, as shown in FIG. 13(*a*). Meanwhile, by altering or changing the waiting time required for braking the motor as described above, the winding position can be shifted appropriately, as shown in FIG. 13(*b*).

Further, in the case in which the outer-circumferential length of the winding roller 38 is substantially the same as twice (n=2) as the storing pitch, the braking operation for the motor 70 is started after the winding roller 38 is further rotated by a ¼ rotation once the banknote is wound around the winding roller 38. Meanwhile, in the case in which such an alteration for the waiting time required for braking the motor is not performed, the banknotes would be respectively wound around the winding roller 38, unevenly, in substantially the same positions, as shown in FIG. 14(*a*). It is noted that FIG. 14(*a*) shows one example in which the banknotes N1 to N10 are wound in this order. In this case, the banknotes N3, N5, N7, N9 are wound, respectively, in substantially the same position in which the banknote N1 is already wound, while the banknotes N4, N6, B8, N10 are wound, respectively, in substantially the same position in which the banknote N2 is already wound.

In this embodiment, however, since the waiting time required for braking the motor is changed or altered, in accordance with the non-circular detection, the banknotes N1 to N10 can be wound in such a manner as described below. Namely, as shown in FIG. 14(*b*), once the banknotes N1, N2 are respectively wound, the control unit 202 performs the non-circular detection based on the number of the pulses outputted from the rotary encoder. Thereafter, once the banknote N3 is wound in substantially the same position as the banknote N1, the control unit 202 starts the braking operation after the winding roller 38 is further rotated by the ¼ rotation. Thus, the next banknote N4 is wound in a position shifted by the ¼ rotation from the position of the banknote N2, i.e., in the position located between the banknote N1 and the banknote N2.

Thereafter, once the banknote N5 is wound in the position located between the banknote N1 and the banknote N2 and opposite to the position of the banknote N4, the control unit 202 performs again the non-circular detection based on the number of the pulses outputted from the rotary encoder. In this way, once the banknote N6 is wound in substantially the same position as the banknote N4, the control unit 202 starts the braking operation after the winding roller 38 is further rotated by the ¼ rotation. As such, the next banknote N7 is wound in the position shifted by the ¼ rotation from the position of the banknote N5, i.e., in the position of the banknote N2.

Further, once the following banknote N8 is wound in the same position as the banknotes N1, N3, the control unit 202 performs the non-circular detection based on the number of the pulses outputted from the rotary encoder. Thereafter, once the banknote N9 is wound in substantially the same position as the banknotes N2, N7, the control unit 202 starts the braking operation after the winding roller 38 is further rotated by the 1/4 rotation. Thus, the next banknote N10 is wound in the position shifted by the ¼ rotation from the position of the banknotes N1, N3, N8, i.e., in the position of the banknote N5.

Accordingly, in the case in which the outer-circumferential length of the winding roller 38 is substantially equal to n times as the storing pitch, the banknotes can be wound, substantially evenly, around the winding roller 38, by starting the braking operation for the motor 70 after the winding roller 38 is further rotated by the ½ n rotation.

Figure 15:
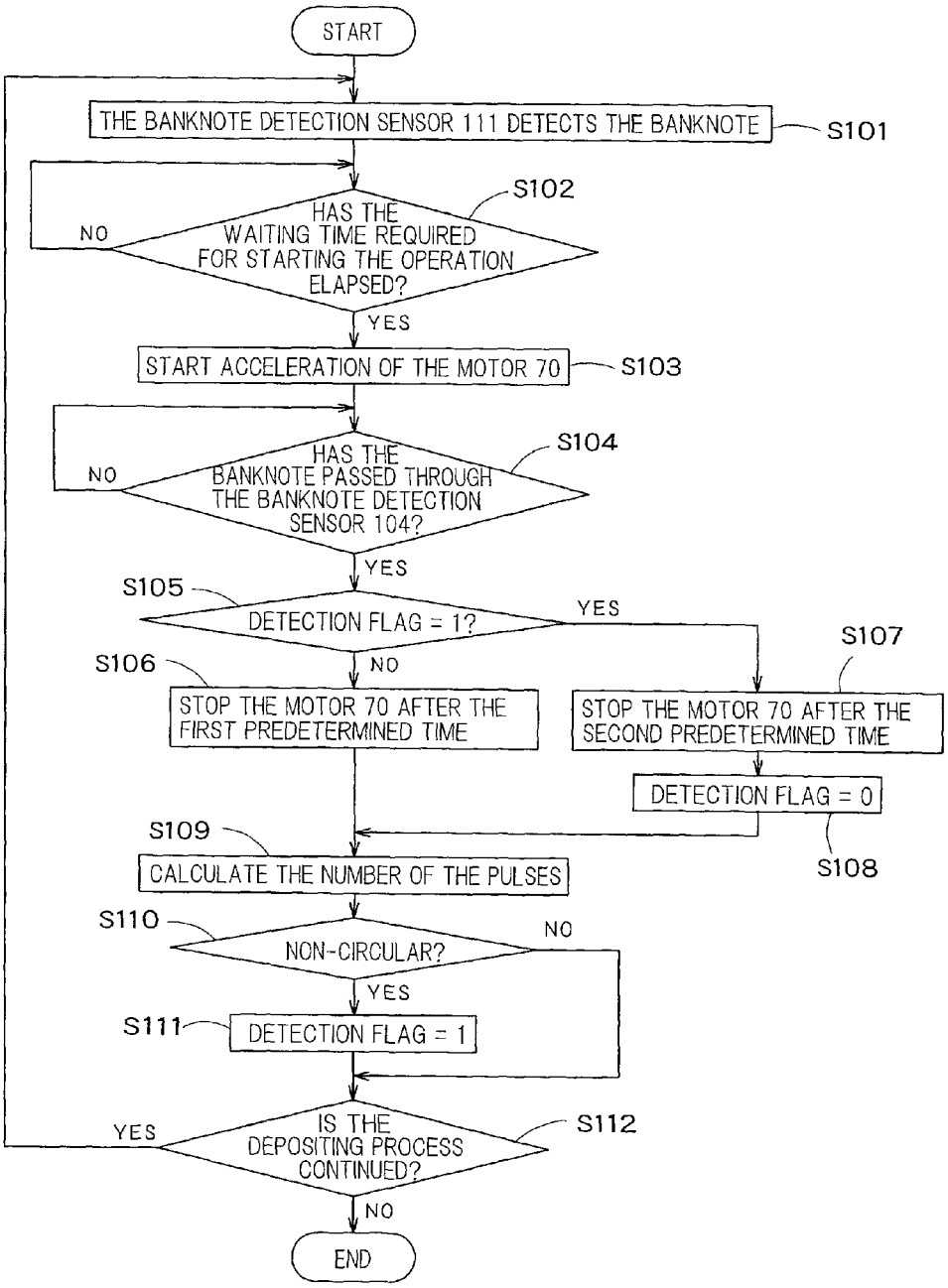
FIG. 15 is a flow chart showing one exemplary method provided for storing the banknotes and related to a fourth embodiment of the present invention.

Now, one method provided for storing the banknotes and related to this embodiment will be discussed, with reference to the flow chart shown in FIG. 15.

(Step S101)

The banknote detection sensor 111 detects one banknote. It is noted that this banknote is already taken into the depositing unit 15, recognized by the recognition unit 18 and subjected to other like necessary processes, before this step S101.

(Step S102)

Whether or not it is preset timing to start the motor 70 is judged. As a result, when it is the timing to start the motor 70, the procedure goes to another step S103.

(Step S103)

The control unit 202 outputs the control command to the drive unit 203, in order to start the acceleration for the motor 70. Further, the control unit 202 starts the counting operation for counting the number of the pulses of the rotary encoder.

(Step S104)

Once the banknote detection sensor 104 detects the passage of the banknote to be stored in the winding roller 38, the procedure goes to another step S105.

(Step S105)

In the case in which a non-circular detection flag is 1, i.e., in the case in which the outer shape of the winding roller 38 is judged to be non-circular, the procedure goes to another step S107. Meanwhile, in the case in which the non-circular detection flag is 0, i.e., in the case in which the outer shape of the winding roller 38 is not judged to be non-circular, the procedure goes to still another step S106.

(Step S106)

After a first predetermined time later than the detection of the passage of the banknote in the step S104, the control unit 202 outputs the control command to the drive unit 203, in order to stop the motor 70, and thus the rotation of the winding roller 38 is stopped. In this case, the first predetermined time is the waiting time required for braking the motor that is used as a standard upon using the first storing pitch. For instance, the first predetermined time is provided for enabling the storing pitch to be set at a possibly minimum value.

(Step S107)

After a second predetermined time later than the detection of the passage of the banknote in the step S104, the control unit 202 outputs the control command to the drive unit 203, in order to stop the motor 70, and thus the rotation of the winding roller 38 is stopped. The second predetermined time is the waiting time required for braking the motor that is used as another standard upon using the second storing pitch. In this case, the second predetermined time is longer than the first predetermined time. With the provision of this second predetermined time, the winding position of the next banknote to be stored can be shifted to allow the outer shape of the winding roller 38 to be approximately circular.

(Step S108)

The non-circular detection flag is set at 0.

(Step S109)

The number of the pulses outputted from the rotary encoder during the period of time required from the step S103 to the step S106 (S107), i.e., the number of the pulses outputted during the period of time in which one banknote is wound around the winding roller 38, is calculated. Then, the calculated number of the pulses is stored in the memory 201.

(Step S110)

Thereafter, whether or not the outer shape of the winding roller 38 is non-circular is judged, based on the number of the pulses calculated in the step S109, the number of the pulses corresponding to the banknotes already stored, and the number of the pulses outputted during one rotation of the winding roller 38.

More specifically, the outer shape of the winding roller 38 is judged to be non-circular in the case in which the total sum of the number of the pulses calculated in the step S109 or the number of the pulses corresponding to the plurality of banknotes wound relatively later becomes substantially equal to the number of the pulses outputted during one rotation of the winding roller 38.

As a result, in the case in which the outer shape of the winding roller 38 is judged to be non-circular, the procedure goes to another step S111. Meanwhile, in the case in which the outer shape of the winding roller 38 is not judged to be non-circular, the procedure goes to still another step S112.

(Step S111)

The non-circular detection flag is set at 1.

(Step S112)

If the depositing process is continued, the procedure returns to the step S101, in order to wait for the storing operation for the next banknote.

In this manner, the control unit 202 can serve to prevent the banknotes from being wound, unevenly, in substantially the same position or positions, by detecting that the outer shape of the winding roller 38 is non-circular and changing the waiting time required for braking the motor.

Therefore, the banknote storing/feeding machine related to this embodiment can prevent the banknotes from being wound around the winding roller 38, unevenly, in substantially the same position or positions.

(Fifth Embodiment)

In the above fourth embodiment, the non-circular detection on the outer shape of the winding roller 38 is performed by using the number of the pulses outputted from the rotary encoder. However, the non-circular detection may be performed, based on the number of the banknotes stored around the winding roller 38.

The following Table 1 is presented to show one exemplary relationship, among the number of the stored banknotes, outer-circumferential length, storing pitch and number of the banknotes wound per rotation, respectively concerning the winding roller 38 and obtained, in advance, by an experiment using the banknotes of the denomination of money to be stored.

TABLE 1

| Number of stored banknotes | Outer-circumferential length (mm) | Storing pitch (mm) | Number of stored banknotes/Number of rotations |
|---|---|---|---|
| 0~153 | 163.5~227.8 | 120 | 1.36~1.89 |
| 154~199 | 228.1~243.9 | 120 | 1.90~2.03 |
| 200~255 | 244.2~262.5 | 125 | 1.95~2.10 |
| 256~400 | 262.8~305.5 | 125 | 2.10~2.44 |
| 401~479 | 305.8~328.0 | 131~156 | 2.33~2.10 |
| 480~550 | 328.3~348.5 | 156~179 | 2.10~1.94 |

In this embodiment, relatively long acceleration time is taken for the number of the stored banknotes equal to or greater than 400, in view of the limit of the torque that can be outputted from the motor 70, thus making the storing pitch relatively large. From this Table 1, it can be seen that about two (sheets of) banknotes are wound during one rotation of the winding roller 38, in the range from 154 to 255 of the number of the stored banknotes as well as in the range from 480 to 550 of the number of the stored banknotes. Namely, in such ranges of the number of the stored banknotes, the banknotes are wound as shown in FIG. 19(*b*), and thus the outer shape of the winding roller 38 will be the ellipse-like shape.

More specifically, in the ranges from 154 to 255 and from 480 to 550 of the number of the stored banknotes, the storing pitch is lengthened by the ¼ rotation of the winding roller 38 each time one or two banknotes are wound. Namely, in the range from 154 to 255 of the number of the stored banknotes, the storing pitch for the next banknote is changed into 180 mm (the second storing pitch) each time one or two banknotes are wound with the storing pitch of 120 mm (the first storing pitch), in order to shift the winding position. Further, in the range from 480 to 550 of the number of the stored banknotes, the storing pitch for the next banknote is changed into 238 to 266 mm each time one or two banknotes are wound with the storing pitch of 156 to 179 mm, in order to shift the winding position.

Figure 16:
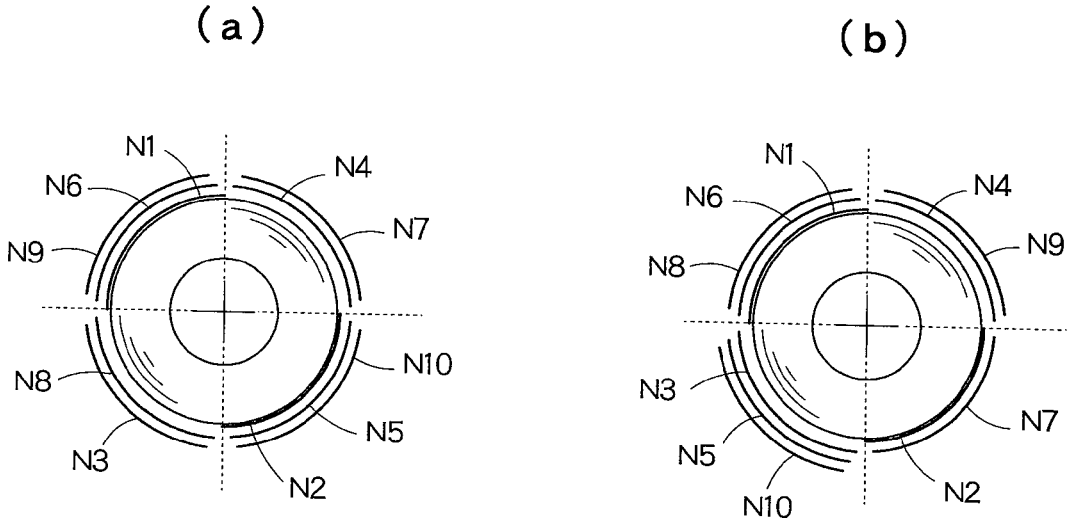
FIG. 16 is a diagram provided for showing still another exemplary state in which the banknotes are wound.

For instance, by changing the storing pitch each time one banknote is wound, the banknotes N1 to N10 that are stored in this order can be wound around the winding roller 38, evenly, as shown in FIG. 16(*a*). Otherwise, by changing the storing pitch each time two banknotes are wound, the banknotes N1 to N10 that are stored in this order can be wound around the winding roller 38, evenly, as shown in FIG. 16(*b*).

Figure 17:
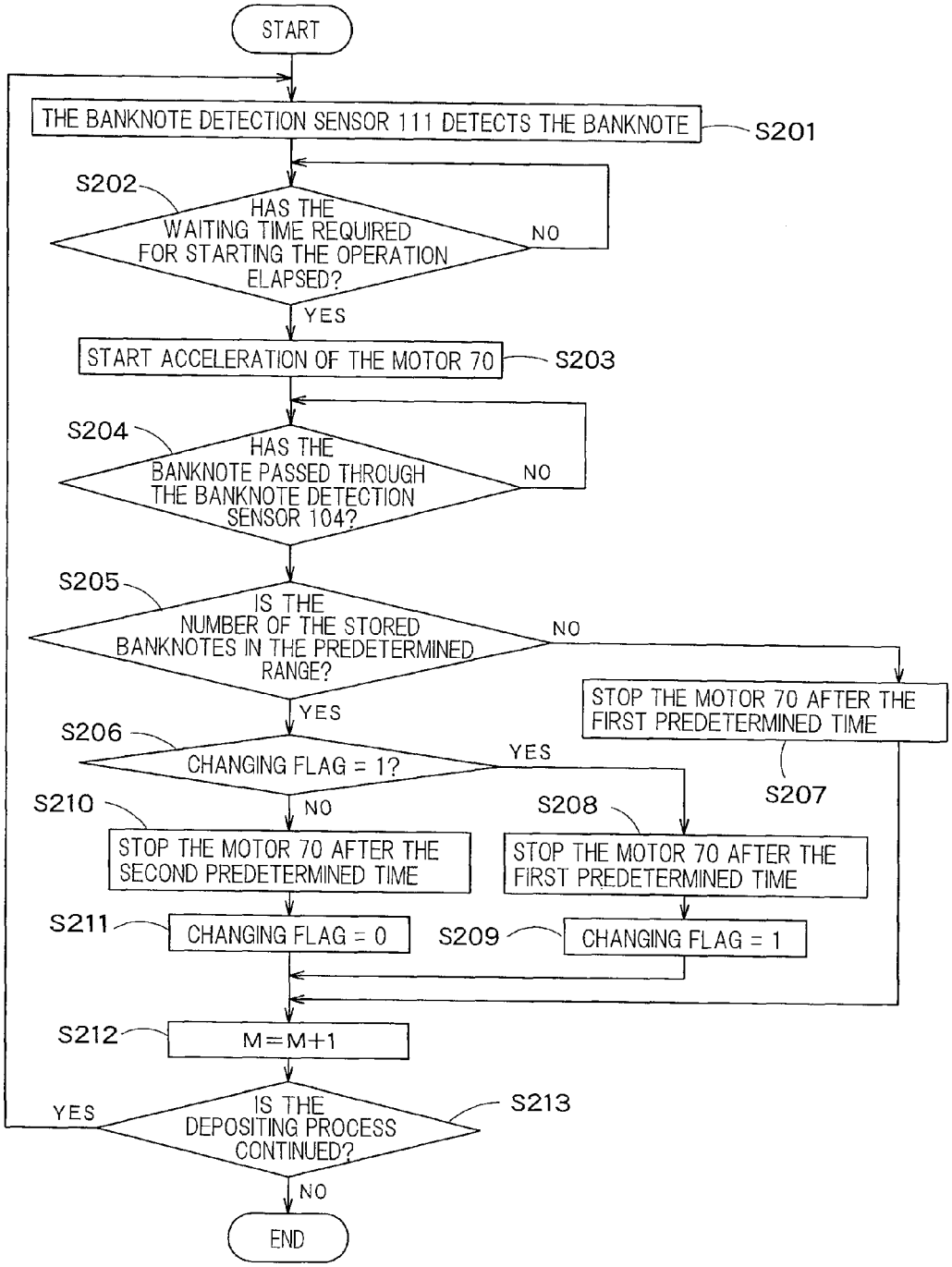
FIG. 17 is a flow chart showing one exemplary method provided for storing the banknotes and related to a fifth embodiment of the present invention.

Now, another method provided for storing the banknotes and related to this embodiment will be discussed, with reference to the flow chart shown in FIG. 17. In this method, one example, in the case in which the number of the banknotes wound per rotation of the winding roller 38 is about two (sheets) and in which the storing pitch for the next banknote is changed each time one banknote is wound, will be described.

(Step S201)

The banknote detection sensor 111 detects one banknote. It is noted that this banknote is already taken into the depositing unit 15, recognized by the recognition unit 18 and subjected to other like necessary processes, before this step S201.

(Step S202)

Whether or not it is the preset timing to start the motor 70 is judged. As a result, when it is the timing to start the motor 70, the procedure goes to another step S203.

(Step S203)

The control unit 202 outputs the control command to the drive unit 203, in order to start the acceleration for the motor 70.

(Step S204)

Once the banknote detection sensor 104 detects the passage of the banknote to be stored in the winding roller 38, the procedure goes to another step S205.

(Step S205)

Whether or not the number M of the banknotes stored around the winding roller 38, which is stored in the memory 201, is in a preset range is judged. Herein, the preset range means the range set for allowing the number of the banknotes stored per rotation of the winding roller 38 to be about two (sheets). For instance, this range corresponds to the range from 154 to 255 and/or the range from 480 to 550 shown in the above Table 1. If the number M of the stored banknotes is in the preset range, the procedure goes to another step S206, while if the number of the stored banknotes is not in the preset range, the procedure goes to still another step S207.

(Step S206)

If a storing-pitch changing flag is 1, i.e., in the case in which the storing pitch is changed, the procedure goes to another step S210. If the storing-pitch changing flag is 0, i.e., in the case in which the storing pitch is not changed, the procedure goes to still another step S208.

(Step S207)

After the first predetermined time later than the detection of the passage of the banknote in the step S204, the control unit 202 outputs the control command to the drive unit 203, in order to stop the motor 70, and thus the rotation of the winding roller 38 is stopped. In this case, for example, the first predetermined time is provided for realizing the storing pitch shown in the Table 1.

(Step S208)

After the first predetermined time later than the detection of the passage of the banknote in the step S204, the control unit 202 outputs the control command to the drive unit 203, in order to stop the motor 70, and thus the rotation of the winding roller 38 is stopped. In this case, for example, the first predetermined time is provided for realizing the storing pitch shown in the Table 1.

(Step S209)

The storing-pitch changing flag is set at 1. Thus, the storing pitch of the next banknote to be transported can be changed.

(Step S210)

After the second predetermined time later than the detection of the passage of the banknote in the step S204, the control unit 202 outputs the control command to the drive unit 203, in order to stop the motor 70, and thus the rotation of the winding roller 38 is stopped. In this case, for example, the second predetermined time is provided for allowing the storing pitch to have the length obtained by adding a ¼ of the outer-circumferential length to the storing pitch shown in the Table 1. Namely, the second predetermined time can be calculated by adding the time obtained by dividing the ¼ of the outer-circumferential length by the tape-winding speed of the winding roller 38 to the first predetermined time.

(Step S211)

The storing-pitch changing flag is set at 0.

(Step S212)

The number M of the banknotes stored around the winding roller 38, which is stored in the memory 201, is counted up by 1.

(Step S213)

If the depositing process is continued, the procedure returns to the step S201, in order to wait for the storing operation for the next banknote.

Namely, as described above, a proper range of the number of the stored banknotes that allows the number of the banknotes wound per rotation of the winding roller 38 to be about 2 (sheets) is obtained in advance. Thereafter, if the number of the stored banknotes is in this range, the storing pitch is changed periodically. Thus, this approach can also prevent the banknotes from being wound around the winding roller 38, unevenly, in substantially the same position or positions.

In this embodiment, whether or not it is necessary to change the storing pitch is judged, based on the number of the stored banknotes. However, the storing pitch may be changed periodically, in the case in which the outer-circumferential length of the winding roller 38 that is measured becomes about n times (n is the integer equal to or greater than 1) as the storing pitch. This approach can also prevent the banknotes from being wound around the winding roller 38, unevenly, in substantially the same position or positions.

The outer-circumferential length of the winding roller 38 can be obtained in various ways. For instance, the outer diameter of the winding roller 38 is measured by using an appropriate sensor provided for detecting the distance between the guide roller 45 (or roller shaft 97) and the motor 70 (or shaft 71). Thus, the outer-circumferential length of the winding roller 38 can be obtained from the measured outer diameter. Alternatively, the time required for one rotation of the winding roller 38 is measured from the number of the pulses outputted from the rotary encoder by using another sensor provided for detecting the length of the tapes 36, 37 respectively rewound from the reels 39, 40. In this way, the outer-circumferential length of the winding roller 38 can be obtained from the length of the tapes 36, 37 respectively rewound during the measured time.

(Sixth Embodiment)

In the above fourth embodiment, the non-circular detection for the outer shape of the winding roller 38 is performed by using the number of the pulses outputted from the rotary encoder. However, the non-circular detection may be performed by another approach. For instance, the distance between the center of the winding roller 38 and the outer circumference of the tapes and banknotes respectively wound around the winding roller 38 is measured at a plurality of points. In this way, the non-circular detection may be performed, based on the difference between the maximum value and the minimum value of the measured distance.

In this case, when the outer shape of the winding roller 38 is circular, the difference is zero (0) because the distance measured at any point is substantially constant. However, when the outer shape of the winding roller 38 becomes non-circular, the difference will be increased as the variation in the distances respectively measured at the plurality of points will be greater. However, in this embodiment, the outer shape of the winding roller 38 is judged to be non-circular when the measured difference becomes equal to or greater than a preset value, and thus the storing pitch is changed periodically.

The detection of the outer diameter at the plurality of points of the winding roller 38 can be performed by first providing the sensor adapted for detecting the distance between the guide roller 45 (or roller shaft 97) and the motor 70 (or shaft 71) and then detecting the distance many times during one rotation of the winding roller 38 by using the sensor.

Alternatively, the outer diameter at the plurality of points of the winding roller 38 can be obtained by providing the contact roller designed to be contacted with the outer-circumferential face of the tapes 36, 37 respectively wound around the winding roller 38, and another sensor adapted for detecting the distance between the contact roller and the motor 70 (or shaft 71).

In such ways, the storing pitch can be changed when the outer shape of the winding roller 38 actually becomes the non-circular shape, such as the ellipse or the like shape, thereby to prevent the banknotes from being wound around the winding roller 38, unevenly, in substantially the same position or positions. In this case, the banknote may be wound in each part where the measured distance is relatively short.

(Seventh Embodiment)

In the above fourth to sixth embodiments, when the outer shape of the winding roller 38 is detected to be non-circular, the storing pitch for the next banknote is changed each time one or two banknotes are stored with a predetermined storing pitch, and then the banknote wound next to the next banknote will be stored with the predetermined pitch.

Meanwhile, in this embodiment, when the outer shape of the winding roller 38 is detected to be non-circular upon the storing process performed with the first storing pitch, each of the following banknotes will be stored with the second storing pitch that is longer than the first storing pitch and is substantially different from a certain value corresponding to about 1/n times (n is the integer equal to or greater than 1) as the outer-circumferential length of the winding roller 38.

Further, in this embodiment, when the outer shape of the winding roller 38 is detected to be non-circular upon the storing process performed with the second storing pitch, each of the following banknotes will be stored with a third storing pitch that is longer than the second pitch and is substantially different from each value corresponding to about 1/n times (n is the integer equal to or greater than 1) as the outer-circumferential length of the winding roller 38.

In this way, the storing pitch is changed to be longer each time the outer shape of the winding roller 38 is detected to be non-circular, thereby to prevent the banknotes from being wound around the winding roller 38, unevenly, in substantially the same position or positions.

As described above, as the storing pitch is gradually increased, the length of each part of the tapes not used for grasping or holding the banknotes, among the tapes wound around the winding roller 38, will be lengthened so much, thus being disadvantageous for increasing the number of the wound banknotes. Therefore, in the case in which the outer shape of the winding roller 38 is detected to be non-circular after the storing pitch is changed into a relatively long pitch, such a long storing pitch may be shortened, on condition that the shortened pitch will be substantially different from each value corresponding to about 1/n times (n is the integer equal to or greater than 1) as the outer-circumferential length of the winding roller 38.

For instance, the storing pitch is first gradually lengthened into 113 mm, 120 mm, 130 mm, 140 mm each time the outer shape of the winding roller 38 is detected to be non-circular. Then, once the storing pitch reaches 140 mm, the storing pitch is shortened into 130 mm, 120 mm, 113 mm each time the outer shape of the winding roller 38 is detected to be non-circular.

This approach for changing the storing pitch can also prevent the banknotes from being wound around the winding roller 38, unevenly, in substantially the same position or positions, as well as can increase the number of the stored banknotes.

In the above fourth to seventh embodiments, the waiting time required for braking the motor is altered, in order to change the storing pitch. However, any other suitable approach than altering the waiting time required for braking the motor may be employed, on condition that the length of the tapes used for winding one banknote can be properly changed.

Figure 18:
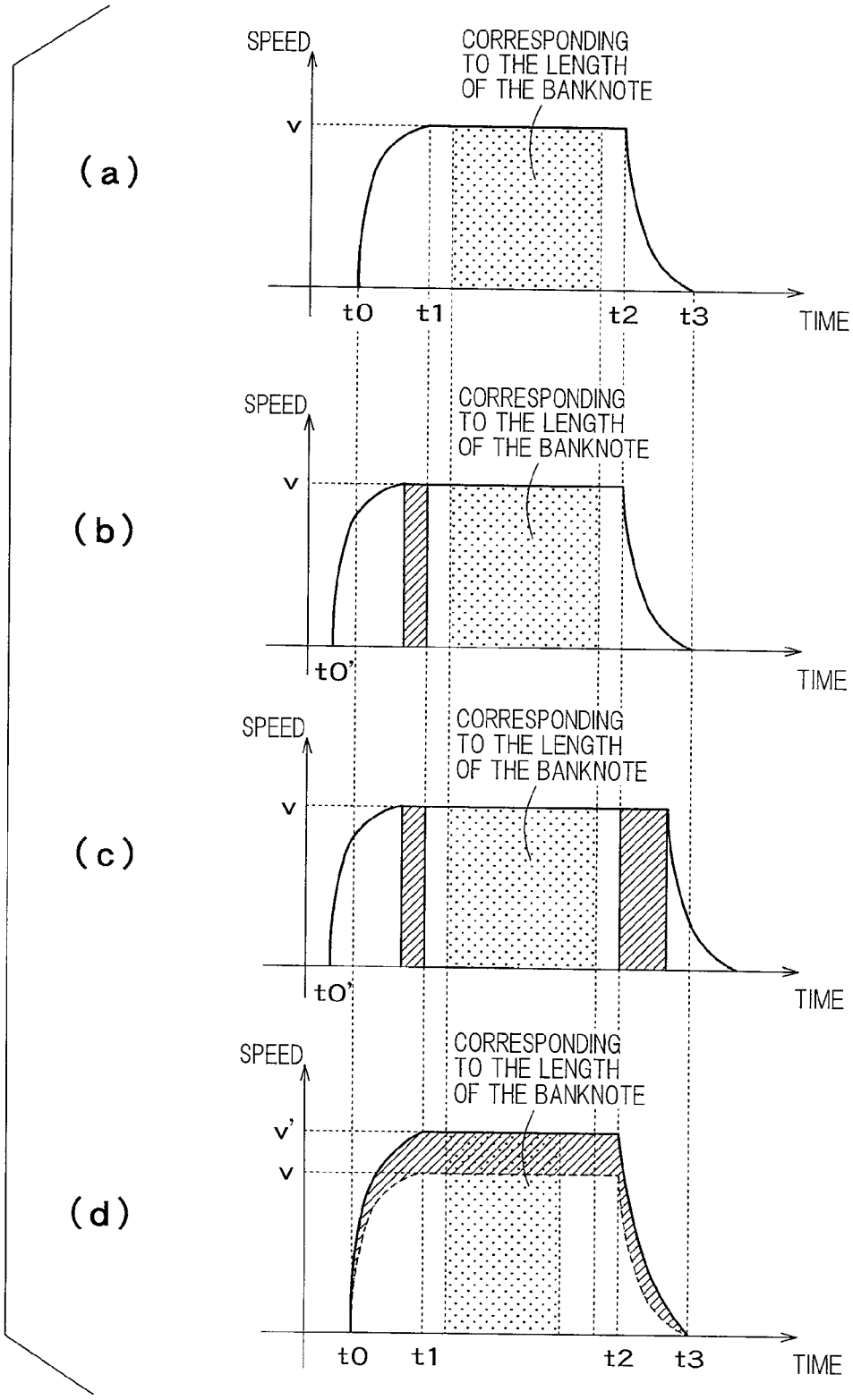
FIG. 18 is another graph provided for showing the changes in the rotation speed of the winding roller.

For instance, the length x1 of the tapes shown in FIG. 4 may be lengthened by shortening the waiting time required for starting the motor 70 or by controlling the start timing of the motor 70 to be earlier. The changes in the rotation speed of the winding roller 38 in this case are shown in FIG. 18(*b*). It is noted that FIG. 18(*a*) shows one exemplary case in which the non-circular shape is not detected, and hence expresses one state similar to the state shown in FIG. 12(*a*). As shown in FIG. 18(*b*), the length of the tapes used for winding one banknote can be lengthened, by an amount corresponding to the area of a part designated by the oblique lines, by starting the acceleration for the motor 70 at time t0' set earlier than the time W.

Further, as shown in FIG. 18(*c*), the waiting time required for braking the motor may be lengthened, with the waiting time required for starting the operation being shortened.

Further, as shown in FIG. 18(*d*), the banknote winding speed of the winding roller 38 may be increased, from the velocity v to another velocity v' faster than the velocity v, by the control operation for controlling the torque of the motor 70, which is performed by the control unit 202. This approach can also lengthen the length of the tapes used for winding one banknote, by the amount corresponding to the area of the part designated by the oblique lines.

Namely, as stated above, once the outer shape of the winding roller 38 is detected to be non-circular, the length of the tapes used for winding one banknote can be changed, by altering the start timing and/or braking start timing for the motor 70, by altering the rotation speed of the winding roller 38, and/or by any other like control means. Therefore, the storing pitch can be suitably changed, thereby to prevent the banknotes from being wound around the winding roller 38, unevenly, in substantially the same position or positions.

In the above embodiments, several examples, in which each banknote or paper sheet is wound together with the two tapes, have been described. However, as reported in the Patent Document 1, another approach, in which the paper sheets are guided to the winding roller by using one tape and a proper guide member, and then wound, together with the tape, around the winding roller, is also applicable to each embodiment of the present invention.

It should be noted that the present invention is not limited to the exact forms of each embodiment described and illustrated herein, but should be construed to cover all modifications, without departing from the scope thereof. Further, it should be appreciated that various inventions can be made by utilizing any suitable combination of a plurality of components respectively disclosed in each embodiment. For instance, several components may be removed from all of the components respectively disclosed in each embodiment. In addition, some components respectively disclosed in different embodiments may be properly combined together.

The invention claimed is:

1. A paper-sheet storing/feeding machine configured to store therein paper sheets, one by one, that are transported thereto, one by one, whereupon the stored paper sheets are fed out therefrom to the exterior, one by one, comprising:

at least one tape;

a winding roller, to which one end of the tape is attached, and which is configured to wind and rewind the paper sheets together with the tape;

a reel, to which the other end of the tape is attached, and which is configured to wind and rewind the tape relative to the winding roller;

a driving source configured to rotate the winding roller;

a sensor configured to detect each paper sheet transported thereto; and a control unit configured to implement a control, each time the transported paper sheet is detected, in which the driving source is controlled to accelerate the winding roller in a winding direction, and decelerate the winding roller after the paper sheet is wound around the winding roller with a tape-winding speed of the winding roller being controlled to be substantially the same as a transport speed of the paper sheet, and configured to control the driving source, in order to change the length of the tape used for storing one paper sheet, thereby to control a storing pitch of the stored paper sheets to be any one of at least two kinds of storing pitches which are larger than a length of each paper sheet, when storing the transported paper sheet.

2. The paper-sheet storing/feeding machine according to claim 1, wherein the storing pitch includes a first storing pitch and a second storing pitch, and the control unit switches the storing pitch from the first storing pitch to the second storing pitch, when a predetermined condition is satisfied.

3. The paper-sheet storing/feeding machine according to claim 2, wherein the storing pitch is switched, under the predetermined condition that one paper sheet stored later is stored around the winding roller in substantially the same position as another paper sheet stored previously, and is overlapped with the paper sheet stored previously.

4. The paper-sheet storing/feeding machine according to claim 3, wherein the predetermined condition is that the outer-circumferential length of the winding roller including the paper sheets and tape respectively wound around the winding roller is in a range that is predetermined based on the length corresponding to an integral multiple of the first storing pitch.

5. The paper-sheet storing/feeding machine according to claim 4, wherein the control unit judges whether or not the outer-circumferential length of the winding roller is in the predetermined range, based on the number of the paper sheets wound per rotation of the winding roller.

6. The paper-sheet storing/feeding machine according to claim 4, wherein the control unit judges whether or not the outer-circumferential length of the winding roller is in the predetermined range, based on a relationship that is obtained, in advance, between the number of the paper sheets wound around the winding roller and the judgment result on whether or not the predetermined condition is satisfied, as well as based on the number of the paper sheets actually wound around the winding roller.

7. The paper-sheet storing/feeding machine according to claim 1, wherein the control unit controls the storing pitch by controlling at least one of a winding length of a part of the tape corresponding to a part of the interval between one paper sheet and another paper sheet that is stored before the one paper sheet, and the winding length of another part of the tape corresponding to another part of the interval between the one paper sheet and still another paper sheet that is stored after the one paper sheet, among the length of the tape used for winding the one paper sheet.

8. A paper-sheet handling machine comprising the paper-sheet storing/feeding machine according to claim 1.

9. A method for storing paper sheets, the method using a paper-sheet storing/feeding machine including:

at least one tape;

a winding roller, to which one end of the tape is attached, and which is configured to wind and rewind the paper sheets, one by one, together with the tape;

a reel, to which the other end of the tape is attached, and which is configured to wind and rewind the tape relative to the winding roller;

a driving source configured to rotate the winding roller; and a sensor configured to detect each paper sheet transported thereto, wherein the method comprises:

detecting each paper sheet by using the sensor;

accelerating the winding roller in a winding direction by using the driving source;

winding the paper sheet around the winding roller with a tape-winding speed of the winding roller being controlled to be substantially the same as a transport speed of the paper sheet;

decelerating the winding roller in the winding direction by using the driving source; and changing the length of the tape used for storing one paper sheet in order to allow the paper sheets to be stored with any one of at least two kinds of storing pitches which are larger than a length of each paper sheet.

* * * * *